US007626295B2

(12) United States Patent
Yamaguchi

(10) Patent No.: US 7,626,295 B2
(45) Date of Patent: Dec. 1, 2009

(54) FLAT ECCENTRIC ROTOR EQUIPPED WITH A FAN AND FLAT VIBRATION MOTOR EQUIPPED WITH A FAN COMPRISING SAME ROTOR

(75) Inventor: Tadao Yamaguchi, Isesaki (JP)

(73) Assignee: Tokyo Parts Industrial Co., Ltd, Gunma-Ken (JP)

( * ) Notice: Subject to any disclaimer, the term of this patent is extended or adjusted under 35 U.S.C. 154(b) by 486 days.

(21) Appl. No.: 11/591,392

(22) Filed: Oct. 31, 2006

(65) Prior Publication Data

US 2007/0104593 A1 May 10, 2007

(30) Foreign Application Priority Data

Nov. 1, 2005 (JP) ..... 2005-318124
Nov. 10, 2005 (JP) ..... 2005-326135
Dec. 14, 2005 (JP) ..... 2005-360023

(51) Int. Cl.
*H02K 7/06* (2006.01)
*H02K 9/06* (2006.01)
*H02K 7/065* (2006.01)

(52) U.S. Cl. ..... 310/81; 310/63; 310/156.32; 310/DIG. 6

(58) Field of Classification Search ..... 310/81, 310/61–62, 156.32, DIG. 6
See application file for complete search history.

(56) References Cited

U.S. PATENT DOCUMENTS 4,885,488 A * 12/1989 Cox ..... 310/68 R
4,922,162 A * 5/1990 Shiraki et al. ..... 310/268
5,471,103 A * 11/1995 Fujii ..... 310/81
2004/0104631 A1* 6/2004 Noguchi ..... 310/81
2004/0227418 A1* 11/2004 Kim ..... 310/81

FOREIGN PATENT DOCUMENTS

JP 9-107653 4/1997
JP 3166757 3/2001
JP 2002-165406 6/2002
JP 3461162 8/2003
JP 3514750 1/2004
JP 2004-72420 3/2004

* cited by examiner

*Primary Examiner*—Burton Mullins
(74) *Attorney, Agent, or Firm*—Jordan and Hamburg LLP

(57) ABSTRACT

An eccentric rotor equipped with a fan is included in an axial gap micro-fan motor for generating vibrations and cooling. The rotor has a first impeller section having a low specific gravity and a second impeller section having a high specific gravity. Each fan comprises a flat section at an upper surface of an axial gap magnet and an impeller section at a side of the magnet. The fans are assembled by concave-convex mating sections at the flat sections and are also bonded to and held by the axial gap magnet. Impeller blades of the fans are optionally formed as backward vanes.

29 Claims, 18 Drawing Sheets

FLAT ECCENTRIC ROTOR EQUIPPED WITH A FAN AND FLAT VIBRATION MOTOR EQUIPPED WITH A FAN COMPRISING SAME ROTOR

BACKGROUND

The present invention relates to a flat eccentric rotor equipped with a fan and a flat vibration motor equipped with a fan comprising the rotor, and more particularly to cooling and noiseless alarm means.

Portable devices such as cellular phones have become more multifunctional, and the conduction time in intermittent operation for demonstrating a vibration function, e.g., of silent alarm means of such multifunctional portable communication devices has increased. Flat vibration motors of a brushless type that have a long service life and flat vibration motors of a coreless type that have high efficiency have come to use following the transition to thin devices.

Cored motors in which armature coils are wound about a plurality of protruding poles that are arranged equidistantly and a drive circuit member is disposed laterally of a stator are known as brushless vibration motors comprising a drive circuit member. An example of such a device is found in Japanese Patent Application Laid-open No. 2000-245103.

However, such motors are large in size in the lateral direction, the efficiency of wiring to a printed circuit board is poor when the motor is set up, and because the motor is of a cored type, it inevitably has a large thickness and is not suitable for practical use.

Furthermore, cored and coreless motors in which an empty space is provided by removing some of a plurality of armature coils and a drive circuit member is disposed in this empty space are also known. Such a motor is disclosed in Japanese Patent Application Laid-open No. 2002-142427.

Brushless motors are typically of a single phase type using one Hall sensor to save cost, but a detent torque generating member that stops the magnet of the motor in a specific position is necessary to self-start the single-phase brushless motor.

Functionality of cellular phones etc. has recently greatly improved, and a problem of heat generation by active electronic components contained therein has assumed great importance. In particular, cabinet cases with zones where a large amount of heat is locally generated, e.g., by a CPU, become hot and inconvenient for people during operation.

Some suggestions to accommodate fixed elements for heat absorption and dissipation, such as ceramic sheets, carbon-graphite sheets, and heat pipes, in order to dissipate locally generated heat have been employed, but the problem can hardly be resolved only by heat absorption by such fixed elements, and the installation of a fan motor serving to circulate air forcibly can be considered.

Units with a size reduced to a square with a side of 20 mm and having a heat sink disposed in the radial direction have recently become known. Such a motor is disclosed in Japanese Patent Application Laid-open No. 9-107653.

However, they are still too large to be accommodated in portable devices, for example, cellular phones.

On the other hand, a flat coreless vibration motor is known which comprises a plurality of hollow armature coils and an eccentric weight made from tungsten and disposed in a space where no coils are located and in which an eccentric rotor integrated with a resin is driven with an axial-gap magnet. Such a motor is disclosed in Japanese Patent Application Laid-open No. 3514750.

A vibration motor comprising a fan in which an eccentric weight is mounted on an output shaft of a cylindrical motor was disclosed and used, this motor additionally having an impeller formed on an outer periphery of the eccentric weight. Such a motor is disclosed in Japanese Patent Application Laid-open No. 2004-72420.

However, with such configuration, because an impeller is additionally provided on the eccentric weight, the risk associated with rotation cannot be ignored. Due to the impeller, a revolution outer periphery has to be considered more thoroughly than the motor body and design restrictions are placed on the configuration.

Furthermore, a large motor of an inner rotor type has been suggested as a brushless vibration motor equipped with a fan and comprising a cored armature, this motor having a large length in the axial direction and having a through hole opened eccentrically without changing the diameter of the cored rotor, wherein cooling is carried out by a process in which the air flows into the hole due to the rotation of the rotor and this air is spread in the radial direction by a centrifugal fan that is disposed axially. Such a motor is disclosed in Japanese Patent Application Laid-open No. 2002-165406. However, such motor is too large to be accommodated in a portable device, for example a cellular phone, and does not match a trend toward thickness reduction.

SUMMARY OF THE INVENTION

Installing a vibration motor as silent alarm means in cellular phones has recently become a necessity. Furthermore, from a design standpoint, virtually no consideration can be given to space for installing a fan motor. Accordingly, the present invention provides a flat rotor with an eccentric member and an impeller by using revolution space of the eccentric member, thereby obtaining a flat eccentric rotor equipped with a fan and producing a unit motor with a noiseless alarm based on generation of vibrations and en effective cooling and dissipation of heat locally generated by active electronic members.

The above-described problems can be resolved with a flat eccentric rotor equipped with a fan. Such an eccentric rotor equipped with a fan comprises a shaft support section provided in a center of rotation, an electromagnetic drive device disposed radially outwardly of the shaft support section, an eccentric weighting device shifting a center of gravity eccentric radially outwardly of the shaft support section, and an impeller section provided in at least one portion on the outer periphery. As used herein the term impeller section refers to structure having one or more impeller blades, or simply impellers as the term impeller may refer to an individual blade or a structure of a plurality of such blades.

More specifically, the eccentric rotor may have a configuration in which the electromagnetic drive device is an axial-gap magnet, the center of gravity eccentric device is optionally an eccentric member comprising tungsten and disposed at least radially outwardly of the magnet, and a fan of a low specific gravity comprising an impeller section disposed at least on the opposite side of the eccentric member, or a configuration in which the impeller section of the fan with a low specific gravity and the outer periphery of the eccentric member at least partially extend in the axial direction.

Furthermore, even more specifically, the eccentric rotor may have a configuration in which the eccentric member is also configured as a fan with a high specific gravity where an impeller section is formed, each fan comprises a flat section above the axial-gap magnet and an impeller section disposed radially outwardly of the magnet, the fans are assembled at the flat sections and are bonded to and held by the axial-gap magnet, or a configuration in which the impeller sections have backward vanes, or blades, and are formed to have revolution [circumferences] outer peripheries, or outermost diameters of rotation, of almost the same diameter, and the impeller section of the fan with a large specific gravity is formed to have a blade with a large thickness, i.e., greater circumferential length than that of a blade of the other fan.

In another implementation mode, the eccentric rotor may have a configuration in which a thin magnetic plate is disposed on the upper surface of the axial-gap magnet, a shaft support section is provided in the magnetic plate, and the impeller section of at least the fan with a low specific gravity is formed from a resin integrally with the magnetic plate.

In another implementation mode of a brushless eccentric rotor, the shaft support section is provided at a cup-shaped rotor case, the electromagnetic drive device is a radial-gap magnet disposed inside the rotor case, the eccentric weighting device is an arc-shaped eccentric member disposed at least outwardly of the magnet, and the side periphery of the rotor case is cut open at least at the side opposite the eccentric member via the center of rotation to form an impeller section.

More specifically, in this eccentric rotor, the eccentric member is also made of an impeller section with a large thickness in the circular arc direction, i.e., a circumferential length, and the impeller sections have blades of a backward, vane-shape type and are formed so that the revolution circumferences i.e., outermost subscribed areas of rotation thereof are of almost the same diameter.

The present invention provides exemplary embodiment wherein a flat-type vibration motor equipped with a fan may have the following structural elements: a flat eccentric rotor of any one of the above described variations; a housing comprising a case accommodating the flat eccentric rotor and a bracket and is provided with an outside air inflow port in the axial direction and an outside air outflow port in the radial direction; a stator disposed in part of the housing, wherein the stator comprises a single-phase armature coil for driving the eccentric rotor, a detent torque generating member for stalling the magnet in a prescribed position, and one drive circuit member of a Hall sensor type for supplying electric power to the armature coil.

In another implementation mode of the flat eccentric rotor, as described above, the electromagnetic drive device can be achieved by comprising a commutator disposed on one side of a printed circuit board and a hollow armature coil disposed radially outwardly of the shaft support section on the other side of the printed circuit board for receiving electric power from the commutator.

More specifically, the impeller section may be formed from a metal plate on optionally its entire outer periphery, a part thereof may hang down, or extend, in the axial direction of the rotor, and an eccentric weight made from tungsten may be disposed as the eccentric weighting device.

Furthermore, the flat eccentric rotor related above may have a configuration in which the impeller section is formed to have a blade or blades of a backward vane shape, a tungsten eccentric weight is disposed as the eccentric weighting device, the eccentric weight is formed to have a diameter equal to that of revolution circumference, or outermost diameter of rotation and an area subscribed thereby, of the impeller section of the weight is configured to have a thick backward impeller blade, and part of each impeller section extends in the axial direction.

As described above, the hollow armature coil and the eccentric weight may be integrated with a resin via the printed circuit board and at least part of the impeller section may be formed from the same resin.

The present invention further provides a flat vibration motor equipped with a fan comprising the following structural elements: a flat eccentric rotor of the above-related variations; a housing comprising a case accommodating the flat eccentric rotor and a bracket and provided with an outside air inflow port in the axial direction and an outside air outflow port in the radial direction; an axial-gap magnet disposed so as to be adjacent to the flat eccentric rotor in part of the housing; a brush that is brought into sliding contact by a distal end portion thereof with a commutator of the flat eccentric rotor inside of the magnet, and a brush conductor having the base end portion of the brush disposed thereat, wherein part of the brush conductor is disposed recessed in a cut extending transversally below the axial-gap magnet and led out sidewise to provide a power supply terminal.

Another configuration of the above-described flat-type vibration motor equipped with a fan can be obtained when at least part of the housing has an angular shape in the plan view thereof and a heat-dissipating fin functioning as an outside air outflow port is disposed in one corner of the housing.

With the present invention, though a single rotor is used, vibrations can be generated by a center of gravity eccentric device during the rotation and, at the same time, an air flow can be created in the radial direction by the impeller section. The amount of vibrations can be made especially large if the difference in specific gravity between the gravity eccentric device and impeller section is increased.

With the present invention, an eccentric rotor of a brushless and slotless type can be obtained and the eccentric member is made from tungsten. Therefore, the difference in specific gravity can be increased and the amount of vibrations can be increased.

With the present invention, the dependent portion described above as extending in the axial direction can use a dead space on the stator side. Therefore, the amount of vibrations and the air flow can be increased without sacrifices in terms of thickness.

The present invention described above provides fans that are fixed securely via an interlocking section and/or bonding to an axial-gap magnet. Therefore, a sufficient strength can be ensured.

The present invention provides an embodiment wherein, because the entire periphery of the revolution space, including the eccentric member, serves as a vane-type backward fan, effective air suction from the axial direction and radial discharge air flow can be obtained. Furthermore, because the impeller section of the fan with a low specific gravity is disposed by using the revolution space of the eccentric member, the size in the radial direction is not sacrificed.

The present invention further provides an embodiment wherein, the magnetic circuit of the axial-gap magnet can be made of a thin magnetic sheet and a frame during integration with a resin can be attained. Furthermore, because the impeller section of the fan with a low specific gravity is made from a resin, the difference in specific gravity can be made as large as 15 or more. As a result, the position of the center of gravity can be displaced significantly in the radial direction and the amount of centrifugal vibrations is increased.

The present invention also provides an embodiment wherein, the impeller section can be easily formed by cutting open the rotor case and a rotor is obtained in which the cooling function and vibration function of a portable device can be obtained simultaneously with a single cored brushless motor.

The present invention provides an embodiment wherein, the entire periphery of the rotor serves as an impeller section. Therefore the amount of air flow can be increased The present invention still further provides an embodiment wherein, though a single rotor is used, centrifugal vibrations can be generated during rotation because the center of gravity is displaced and also an air flow can be generated by the impeller section. Furthermore, the outside air inflow-outflow port disposed in the case effectively provide for the inflow of outside air and pushed-out air flow. As a result, the vibration function and cooling function of a portable device can be obtained simultaneously. Furthermore, danger is prevented because the impeller section does not protrude to the outside.

The present invention additionally provides an embodiment wherein, an efficient coreless eccentric rotor can be obtained.

The present invention provides yet further an embodiment wherein, the portion depended in the axial direction can use the dead space in the outer radial direction of the magnet on the stator side. Therefore, the amount of vibrations and air flow can be increased without sacrifices in terms of thickness.

The present invention also provides an embodiment wherein, the eccentric weight protrudes as far as the revolution space of the impeller section on the outer periphery. Therefore, the eccentricity is increased. Because the entire periphery of the revolution space, including the eccentric weight, serves as a vane-type backward fan, effective air suction from the axial direction using a negative pressure and effective radial discharge air flow can be obtained. Because the portion depended can use the dead space, the amount of vibrations and air flow can be increased without sacrifices in terms of thickness.

The present invention provides another an embodiment wherein, a strong integration with the coil is possible. In particular, in a configuration in which the fan with a low specific gravity is from a resin and the eccentric device is a tungsten weight, the difference in specific gravity can be increased to 15 or more. Therefore, the center of gravity position displaces significantly in the radial direction and the amount of centrifugal vibrations increases.

Using the coreless eccentric rotor in accordance with configurations of the present invention discussed above improves efficiency. The outside air inflow and outflow ports provided in the case enable effective inflow of the outside air and discharge air flow, the cooling function and vibration function of a portable device can be obtained simultaneously, and danger is prevented because the impeller section does not protrude to the outside.

With the configuration in which the bracket is used as a heat-dissipating fin in accordance with the present invention, the housing can be cooled with good efficiency. In particular, the bracket can be directly installed on the heat-generating element of the device or, if they are linked with a thermally conductive sheet, the heat remaining in the thermally conductive sheet can be easily removed, and the heat-generating element can be cooled with good efficiency. Therefore, the problem of heat generation by active electronic components can be easily resolved.

DETAILED DESCRIPTION OF THE PRESENT INVENTION

The present invention provides a rotor having an eccentric member made from tungsten with a specific gravity of about 18 as a first fan part with a high specific gravity and a second fan part with a low specific gravity formed from a metal plate with a specific gravity of about 9 or less. Each fan part comprises a flat portion on an upper surface of an axial-gap magnet and an impeller portion on a side periphery of the magnet. The fan parts are assembled by protrusion-recess mating at the flat portions and are also adhesively bonded to and held by the axial-gap magnet. Each of the fan parts forms an impeller portion of a backward vane type. The first fan part with the high specific gravity is formed to have a large thickness, i.e., circumferential length. A shaft support section is provided at the flat portion of the second fan part with a low specific gravity.

Figure 1:
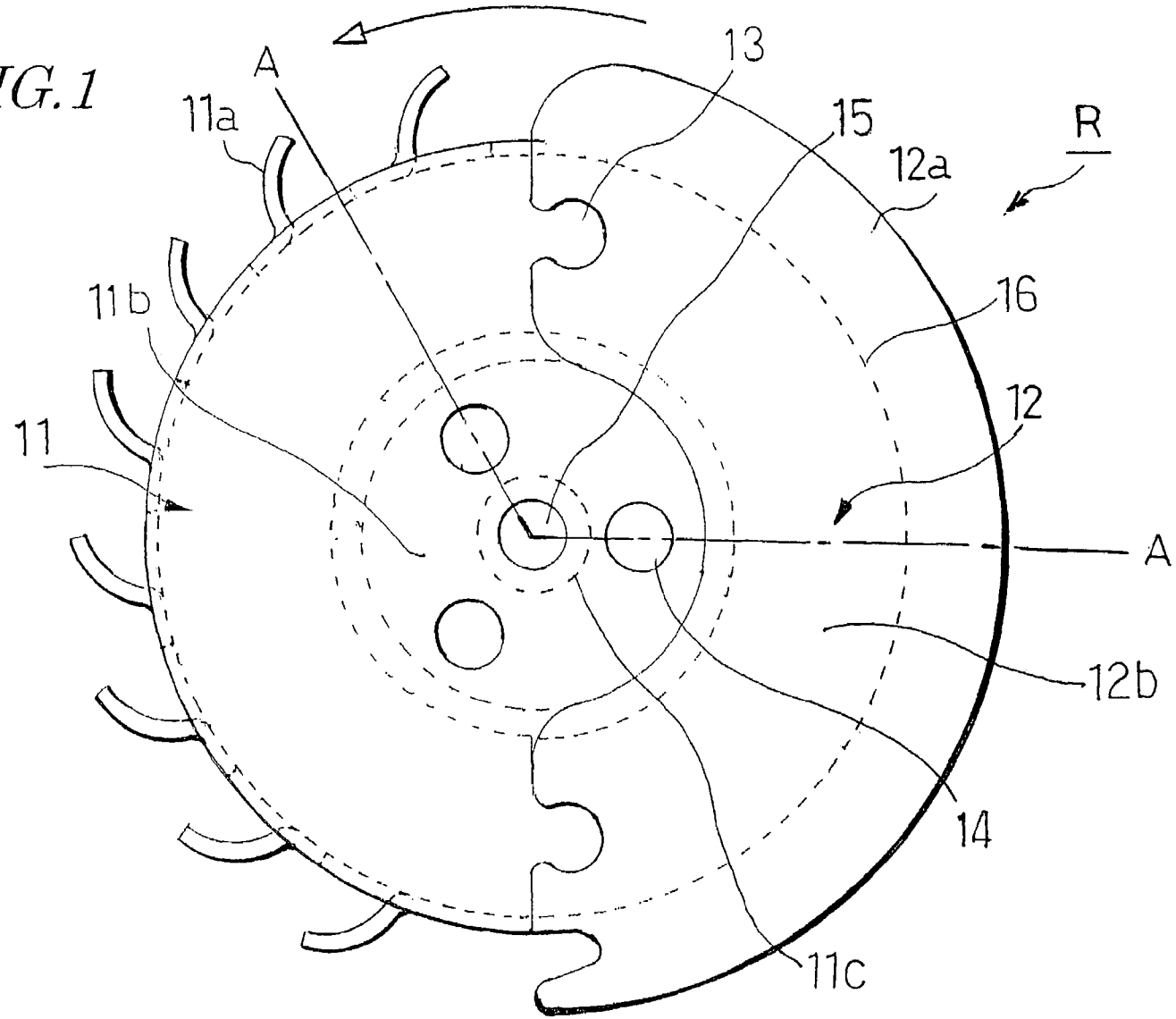
FIG. 1 is a plan view of the eccentric rotor equipped with a fan in accordance with the present invention (Example 1).
Figure 2:
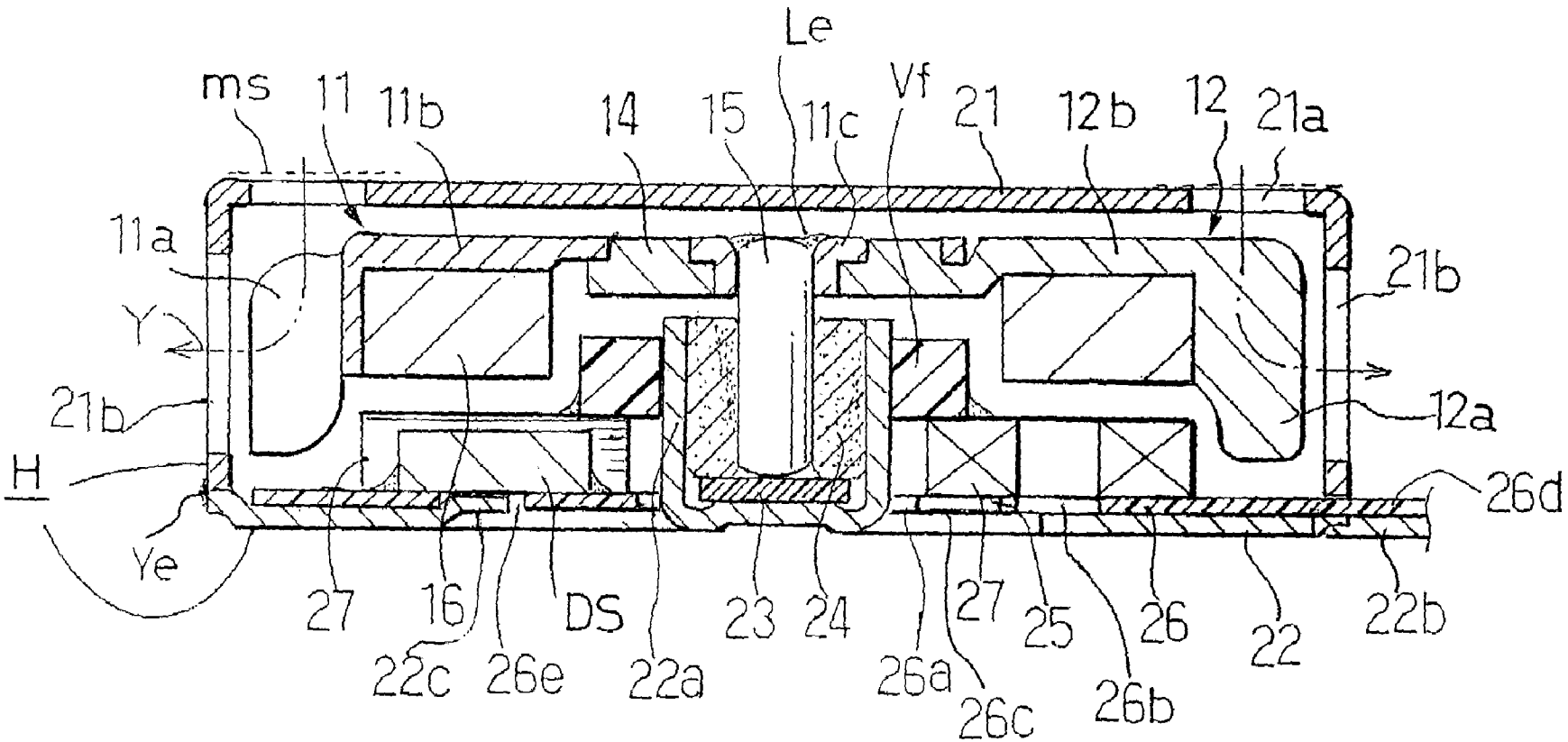
FIG. 2 is a cross-sectional view of the flat brushless motor equipped with a fan in which the rotor shown in FIG. 1 is contained in a state shown by cutting along the A-A line.

Referring to FIG. 1 and FIG. 2, a first embodiment of the invention has an eccentric rotor R, a second fan part 11 with a low specific gravity that comprises a metal plate material with a specific gravity of 4 to about 9 and a first fan part 12 with a high specific gravity made from tungsten are assembled with a key-shaped concave-convex section 13 and a mating concave-convex section 14. In the second fan part 11 a plurality of backward vane-like impellers 11*a* are cut to be in a protruding condition on the outer periphery, and a shaft support section 11*c* of a shallow burr-like shape is provided in a center of rotation of a flat section 11*b* of the second fan part 11.

The first fan part 12 is disposed opposing the impellers 11*a* across a center of rotation and has convex and concave sections at ends thereof provided to the extent of a revolution circumference, or outermost rotational periphery, i.e., path, of the impellers 11*a*, and a circular-arc eccentric member 12*a* formed as an impeller in the form of a large backward vane, and a flat section 12*b* contiguous with the eccentric member 12*a*. A shaft 15 is fixed by laser welding Le at the top portion thereof to the shaft support section 11*c*. A magnet 16 of an axial-gap type is fixedly attached with an anaerobic adhesive around the shaft 15 on the inside of the flat sections 11*b*, 12*b* of the second fan part 11 and the first fan part 12 so as to reinforce and mate them together.

Therefore, the second fan part 11 and the first fan part 12 are assembled by using the concave-convex sections and also strongly assembled with the adhesive via the magnet 16.

An eccentric rotor R equipped with a fan and having the above-described configuration is accommodated in a housing H comprising a case 21 and a bracket 22, as shown in FIG. 2. A plurality of outside air inflow ports 21*a* are provided in a top section of the case 21, and an outflow port 21*b* through which the introduced outside air flows out is provided in a side section of the case 21. The outflow port 21*b* may be provided in one location in the direction of the active electronic component that is to be cooled or a plurality of the outflow ports may be provided to push out the air flow over an entire outer periphery. A mesh sheet ms may be attached if penetration of foreign matter from the outside air inflow ports 21*a* is a concern.

With such a configuration, because each impeller 11*a* of the eccentric rotor is formed as a backward vane, when the rotor is rotated as shown by an arrow shown in FIG. 1, outside air is sucked in by a negative pressure through the outside air inflow ports 21*a* located in the top section as shown by a virtual line Y shown in FIG. 2, and also outside air is pushed out and flows radially, under the effect of a positive pressure, from the outflow port 21*b* located in the side section.

The bracket 22 is formed of a metal sheet of a non-magnetic or weakly magnetic stainless steel with a thickness of about 0.2 mm, a plurality of support columns are punched in a center of the bracket 22 using press processing so as to protrude therefrom, forming a bearing holder 22*a*. A thrust washer 23 is arranged in the bottom section of the bearing holder 22*a*, a bearing 24 rotatably supporting the eccentric rotor R via the shaft 15 is fit at the thrust washer 23, and the base end of the shaft 15 is pivotally supported on the thrust washer 23.

A power feed terminal carrying section 22*b* is provided in an extending condition on a side of the bracket 22, and a detent torque generating member 25 made of a magnetic stainless steel sheet with a thickness of about 0.1 mm is disposed on a top surface of the bracket 22 by using the bearing holder 22*a* as an alignment guide.

Figure 5:
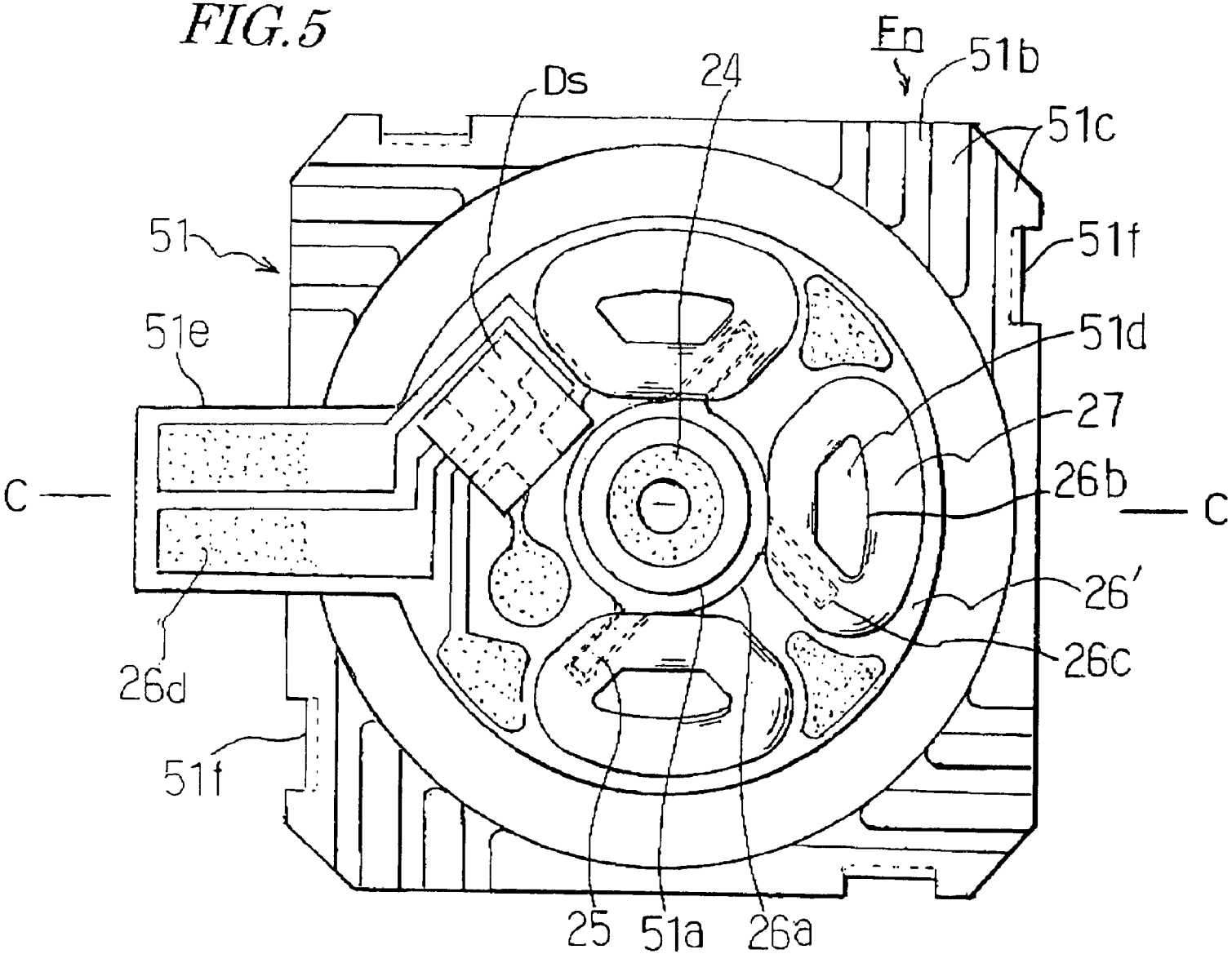
FIG. 5 is a plan view of a modification example of the stator portion shown in FIG. 2 (Example 3).

A stator base 26 which is assembled with the detent torque generating member 25 is made from a glass cloth—epoxy resin substrate with a thickness of about 0.15 mm, and a through hole 26*a* arranged around a center of the detent torque generating member 25, guide holes 26*b* for hollow armature coil mounting formed with a pitch of 90° outwardly in the radial direction thereof, and three groove holes 26*c* passing in the radial direction from the through hole 26*a* are formed with an arrangement opening angle of 90° in the center, as shown in FIG. 5 illustrating a stator according to a third embodiment described below.

The position of the groove hole 26*c* is determined by the number of poles of the axial-gap magnet 16 of the assembled rotor. Here, when the number of poles of the magnet is four (opening angle of the magnetic poles is 90°), the position of the groove hole is about 22.5° from the center of each guide hole 26*b* for hollow armature coil mounting, which is the center of the hollow armature coil, that has to be arranged so as to provide for a reliable start for both the peak or neutral of the magnetic pole.

Obviously, in the case of six poles with an opening angle of the magnetic poles of 60°, a position at 15° from the center of each armature coil is selected.

In this case, because the detent torque generating member 25 is accommodated in the through hole 26*a* and three groove holes 26*c*, it is fit within the thickness of the stator base 26 and the thickness thereof can be ignored.

Three hollow armature coils 27, as shown in FIG. 5 in a further embodiment of the present invention, are arranged on an upper surface of a stator base 26 by using the guide holes 26*b* for hollow armature coil mounting and fixed with a UV-curable adhesive. The terminals of the coils 27 are connected to the desired wire connection pattern to obtain a single phase (not shown in the figure).

It is not always necessary to employ the guide holes 26*b* for hollow armature coil mounting, provided that a process is employed in which each hollow armature coil is mounted on a jig and then bonded to the stator base 26.

A Hall sensor-containing drive circuit member DS for driving the hollow armature coils 27 is installed with a solder wire connection in a position in which an adequate electric neutral point can be obtained, so that the drive circuit member does not overlap the hollow armature coils 27 in a plan view, and the power is supplied from power supply terminals 26*d* located on a side thereof.

The position of the Hall sensor contained in the drive circuit member DS is set in correspondence to magnetic poles of the magnet that will be employed. Here, when the number of poles of the magnet 16 is four, positions of 45°, 90°, 135° or 180° from a center of each armature coil are selected.

The stator base 26 thus obtained is installed on the bracket 22 with an anaerobic adhesive. At this time, the detent torque generating member 25 is mounted in the groove hole 26*c* and the through hole 26*a* is fit on an outside of a central outer contour of the detent torque generating member 25. Therefore, the detent torque generating member 25 is completely confined in a thickness direction of the stator base 26 and, therefore, the thickness of the detent torque generating member 25 may be completely ignored.

Thus, the detent torque generating member 25 can be set in an optimum position, without confinement to inside the hollow armature coil 27.

Penetration of foreign matter can be prevented because the port obtained after the bearing holder 22*a* has been press punched and caused to protrude, is covered with the stator base 26.

Here, in order to cause a thermal bias of the drive circuit member DC, a through hole 26*e* is opened in the underlying stator base 26, as shown in FIG. 2, and part 22*c* of the bracket 22 is connected via a thermally conductive grease or the like to a bottom surface of the drive circuit member DC via the hole 26*e*. As a result, heat generation from the drive circuit member DS can be accommodated and unacceptable heat build-up prevented.

A reference symbol Vf shown in FIG. 2 denotes a reinforcing ring made from a vulcanized fiber and designed to ensure the strength of the bearing holder 22*a* formed by the support column. This reinforcing ring Vf is pressed into the support column and bonded to an upper surface of the hollow armature coil 27.

The bracket 22 is thus attached to an opening of the case 21 and fixed by laser welding Ye in several locations on the side thereof, thereby producing a strongly unified housing H with a monocoque structure.

Figure 3:
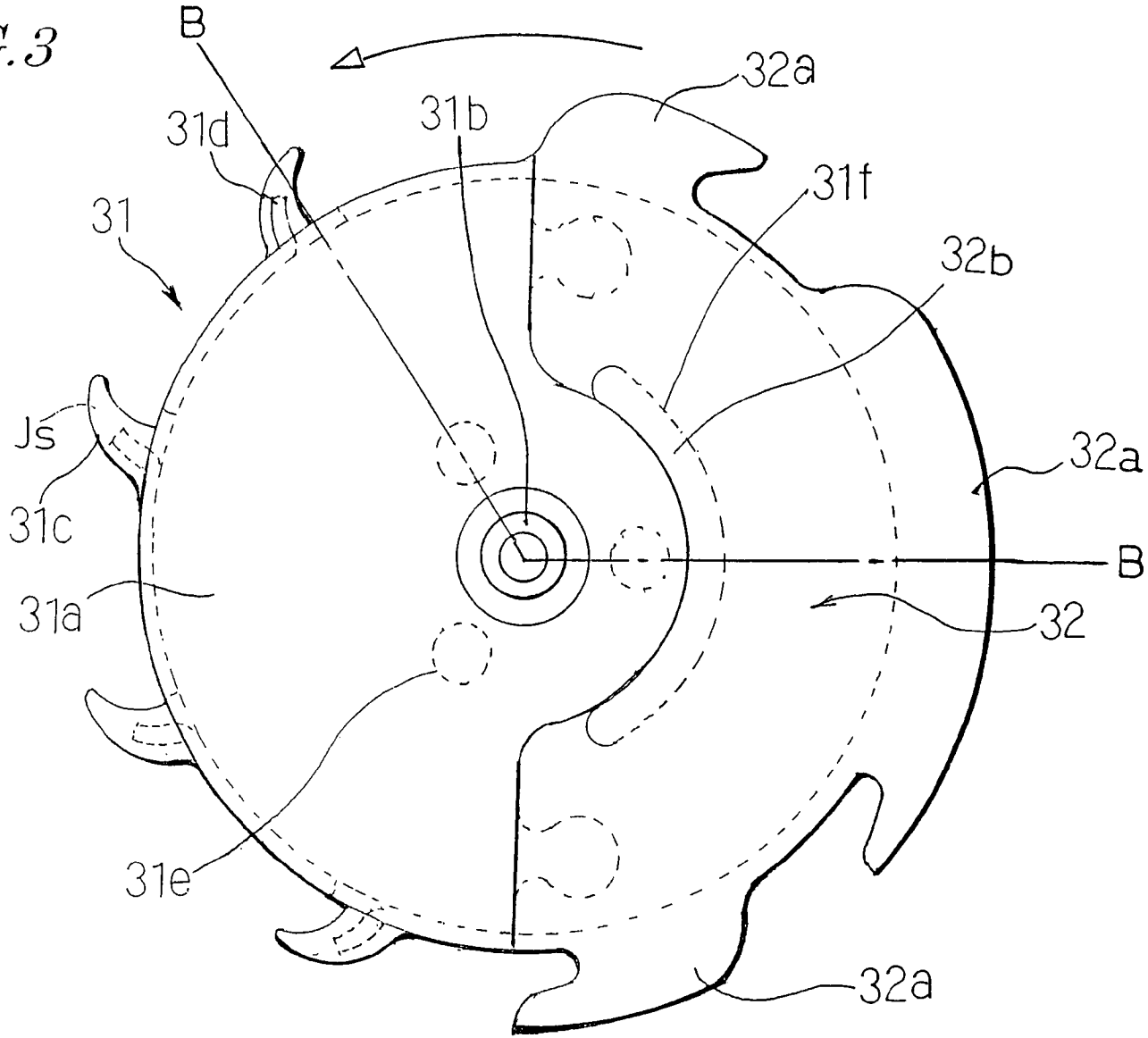
FIG. 3 is a plan view of the first modification example of the eccentric rotor equipped in the fan that is shown in FIG. 1 (Example 2).
Figure 4:
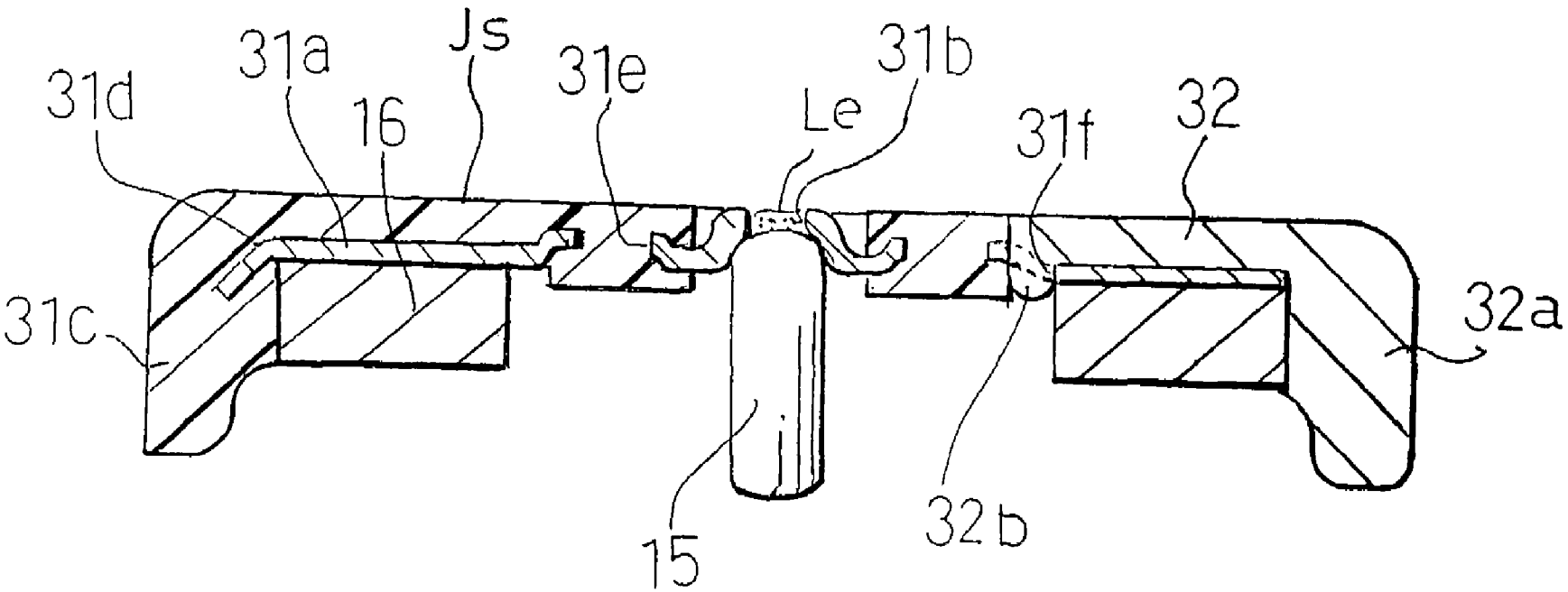
FIG. 4 is a cross-sectional view illustrating the state obtained by cutting along the B-B line in FIG. 3.

FIG. 3 and FIG. 4 illustrate a modification example of a flat eccentric rotor equipped with a fan of a second embodiment. In this example, a thin magnetic sheet 31*a* is disposed on the upper surface of the axial-gap magnet 16 as a fan part 31 with a low specific gravity, a shaft support section 31*b* is provided at the magnetic sheet 31*a*, and at least the impeller 31*c* is formed from a resin Js with a specific gravity of 2 or less integrally with the magnetic sheet 31*a*. A portion cut and raised on an outer periphery of the magnetic sheet 31*a* is included in the impeller 31*c* to serve as a frame 31*d*, and a total of three through holes 31*e* through which the resin Js passes are opened in the impeller 31*c*. The magnetic sheet 31*a* is thereby strongly integrated with the resin Js, and because of the frame 31*d*, the impeller 31*c* can be sufficiently functional, without being damaged despite a low specific gravity of the resin Js.

An eccentric weight 32 made from tungsten and having three backward vane-type impellers 32*a* formed therein is installed by bonding to the magnetic sheet 31*a* on an opposite side of the impeller 31*c*. An arc-like through hole 31*f* is provided in the magnetic sheet 31*a* and a protrusion 32*b* of almost the same size, that protrudes in the axial direction from the eccentric weight 32, is fitted therein, such a configuration eliminating a risk of displacement in the radial direction.

Therefore, the magnetic plate 31*a* makes it possible to configure a magnetic circuit of the axial-gap magnet 16, the strength of the resin Js can be ensured, and if a rotation is conducted in a direction shown by an arrow shown in FIG. 3, the impeller of a backward vane type enables an effective air flow generation.

Figure 6:
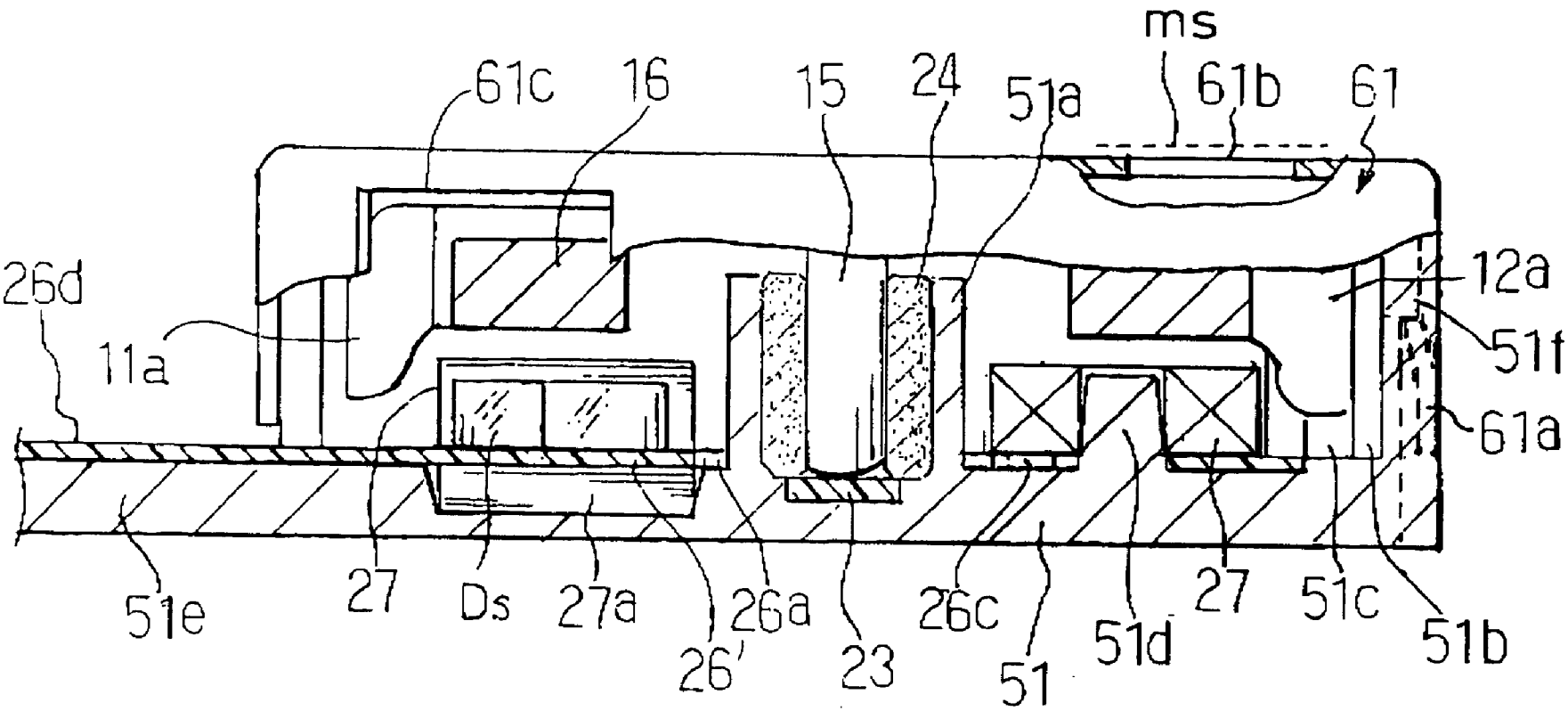
FIG. 6 is a side view with the section of the main portion illustrating the modification example shown in FIG. 2 where the stator shown in FIG. 5 is contained in a state shown by cutting along the C-C line.

FIG. 5 and FIG. 6 show a third embodiment having a structure in which a stator serves as a heat-dissipating fin of a heat sink. A bracket 51 is an aluminum die casting having an angular shape in a plan view thereof. A heat-dissipating fin Fn is formed which has a bearing holder 51*a* rising in a center and grooves 51*b* and walls 51*c* functioning as outflow ports, for directing out the air that flowed in, located at four corners of a square shape of the fin Fn. The above-described thrust washer 23 is disposed in a bottom section of the bearing holder 51*a*, and the above-described bearing 24 is accommodated therein.

The detent torque generating member 25 comprising three radial protrusions, such as shown in FIG. 5, is disposed at the upper surface of the bracket 51 outside the bearing holder 51*a*, this detent torque generating member 25 comprising the above-described magnetic stainless steel sheet with a thickness of about 0.1 mm.

A stator base 26' assembled with the detent torque generating member 25 is made of a glass cloth—epoxy substrate with a thickness of about 0.15 mm in the same manner as described above. The through hole 26*a* is provided around the center of the detent torque generating member 25. The guide holes 26*b* for mounting a hollow armature coil are formed with a pitch of 90° outwardly in the radial direction of the through hole and are opened in the center. The three groove holes 26*c* are formed with an arrangement opening angle of 90° in the radial direction so as to be linked to the through hole 26*a*. In order to dissipate the heat generated when an electric current is passed through the hollow armature coil 27, protrusions 51*d* inserted into the holes 26*b* for mounting a hollow armature coil extend from the bracket 51 and are preferably formed integrally therewith. A power feed terminal carrying section 51*e* is extended sidewise.

Here, in addition to the three hollow armature coils 27 mounted by using the above-described hollow armature coil alignment guides, a fourth hollow armature coil 27*a* is made slightly thinner than a thickness of the aluminum die casting of the bracket 51 and is installed below the stator base 26'. This additional coil is wired in a signal phase with the three hollow armature coils and makes a contribution to increase torque.

In the bracket 51, a locking portion 51*f* for fixing a mounting leg section 61*a* of a case 61 is formed at an outside wall 51*c* constituting the heat-dissipating fin Fn.

The case 61 has opened therein a plurality of outside air inflow ports 61*b* provided in the axial direction, and sidewise outflow ports 61*c*, enabling flow of air in the radial direction, provided in positions other than those of the mounting leg section 61*a*. The mounting leg section 61*a* is locked to the locking portion 51*f* of the bracket 51. The outflow port may be provided in one location in a specific direction or may be provided in four locations to ensure the flow of air from the entire body.

With the vibration motor equipped with a fan and having the above-described configuration, if a device is installed via a thermally conductive sheet, for example, made from carbon or graphite as exemplified by the below-described installation structure, then the heat generated by the active electronic components will be transferred via the thermally conductive sheet to the heat-dissipating fins made from aluminum and effective cooling will be provided with the air flow.

Figure 7:
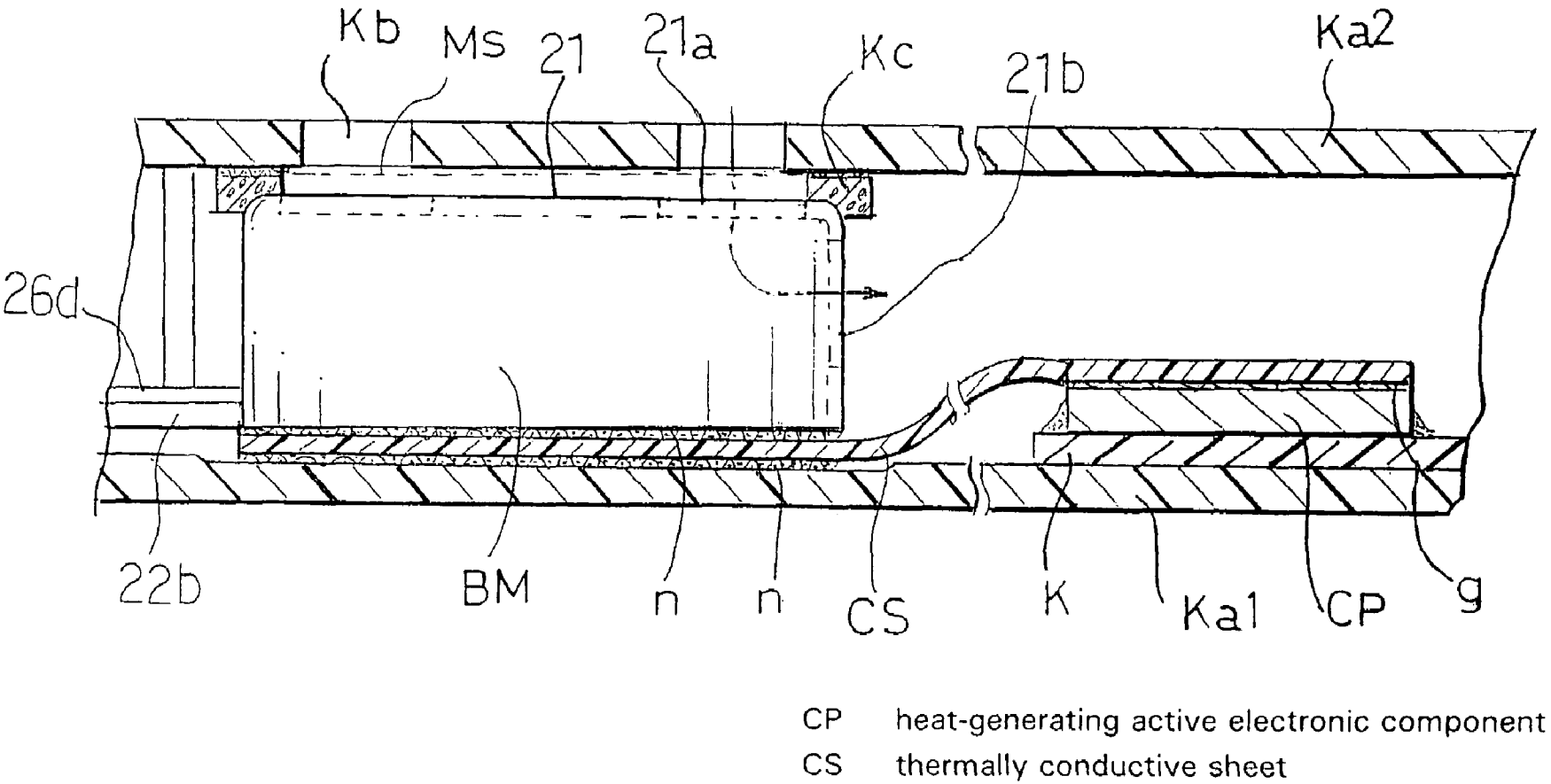
FIG. 7 is a cross-sectional view of the main portion of the device installation structure of the flat motor equipped with a fan that is shown in FIG. 2 (Example 4).

In a fourth embodiment as shown in FIG. 7, when there is no space for disposing the above-described flat brushless vibration motor equipped with a fan on a heat-generating active electronic component CP such as a central processing unit or power amplifier, an above-described motor BM is installed adjacent the heat-generating active electronic component CP and they are connected with a thermally conductive sheet CS.

Thus, a thermally conductive sheet CS comprising carbon and graphite is disposed via, e.g., grease g with good thermal conductivity or a pressure sensitive adhesive on an upper surface of a power amplifier or a heat-generating active electronic component CP disposed on a main board K of a lower cabinet Ka1. The thermally conductive sheet CS is configured to reach the bottom surface of the bracket (here, represented by way of an example by the bracket 22 of the first embodiment) of the motor BM extending in a transverse direction.

Here, the motor BM is carried on the lower cabinet Ka1 with two-surface pressure sensitive materials sandwiching the thermally conductive sheet CS. A through hole Kb for introducing outside air and a mesh sheet Ms for preventing penetration of foreign matter are disposed in the cabinet Ka2 located on the upper surface of the motor BM. Following the rotation of the motor, outside air is guided into the outside air inflow ports 21*a* opened in the case 21 of the motor, outside air is taken into the motor from the axial direction, and the air flows from the outflow port 21*b* in the radial direction, for example, onto the heat-generating active electronic component CP. It is understood that the heat-dissipating fin-type bracket 51 of the third embodiment may be also used in this configuration.

Therefore, with the heat-dissipating fin-type bracket, the heat generated by the heat-generating active electronic component CP is dissipated with the heat-dissipating fin Fn via the thermally conductive sheet CS, and additional cooling is effectively conducted with outside air. As a result, local heat generation and temperature increase of the heat-generating active electronic component CP or the like can be inhibited.

Here, the position of the through hole Kb for introducing outside air is not specifically required to be opposite the motor, and the gaps of the cabinet may be used, provided that they let outside air in.

The reference symbol Kc in the figure stands for a sponge also serving as a seal and ensuring the impact resistance even when the vibration frequency is decreased and the amplitude is increased.

Figure 8:
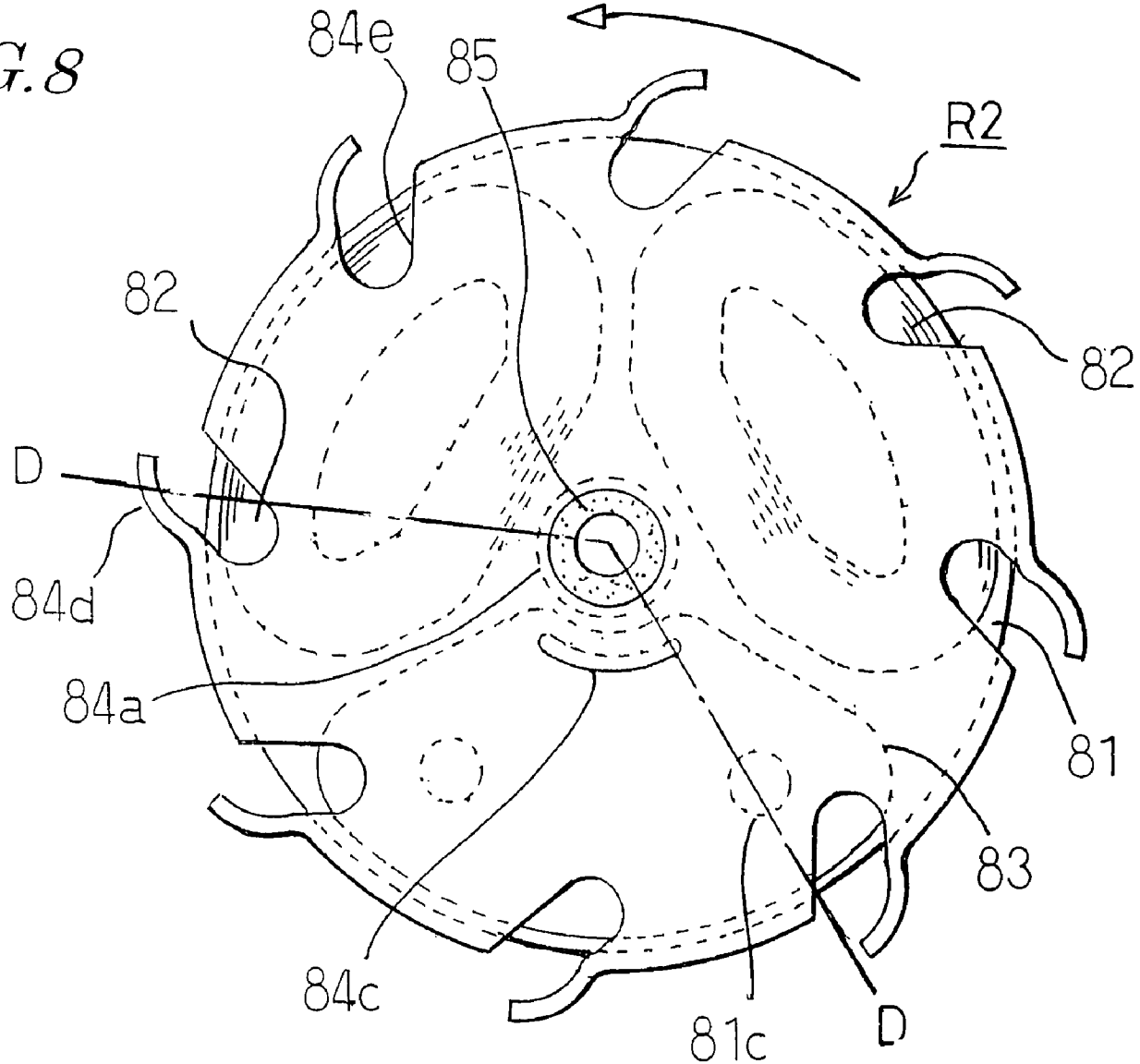
FIG. 8 is a plan view illustrating another implementation mode of the eccentric rotor in accordance with the present invention (Example 5).
Figure 9:
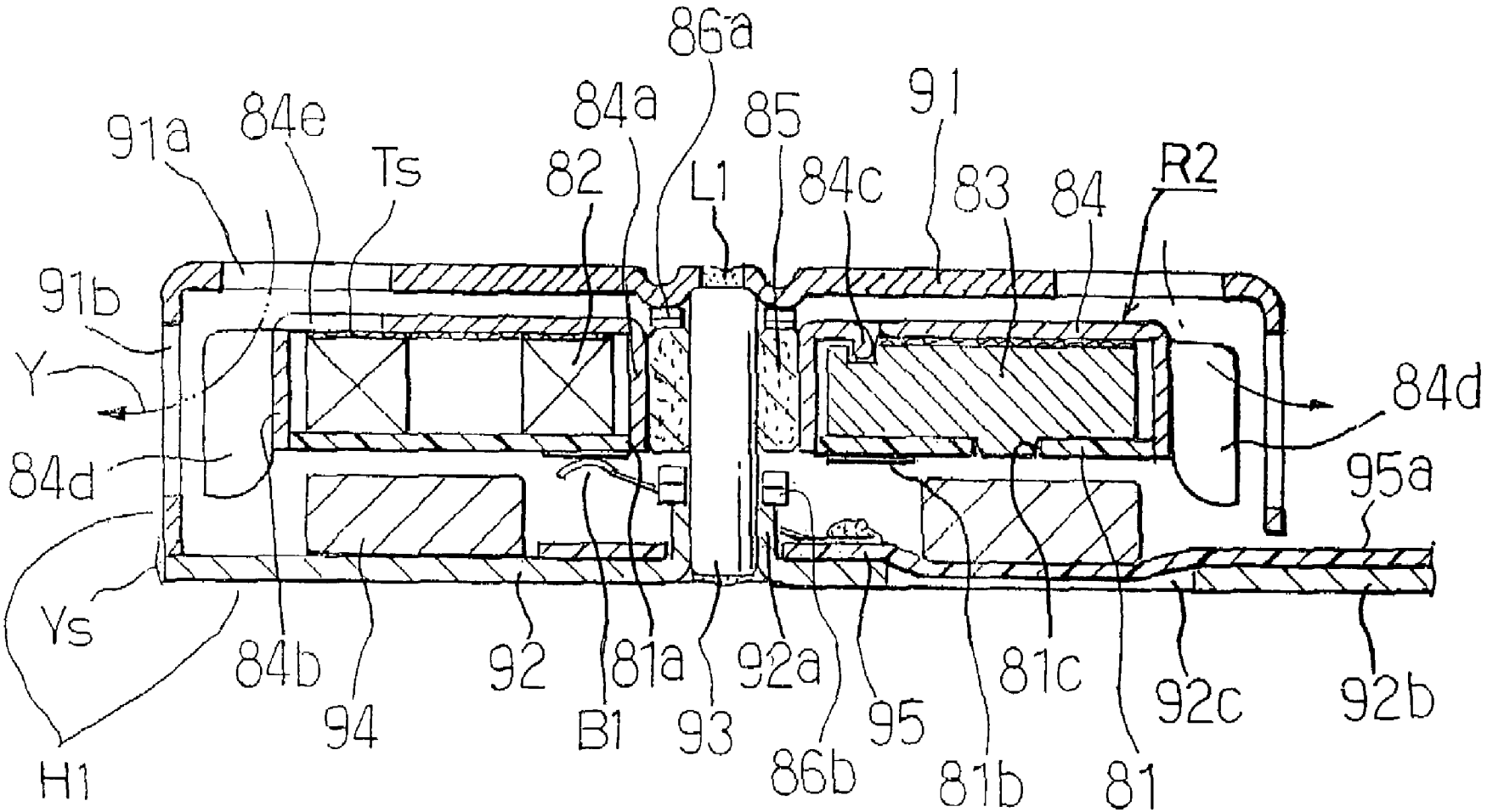
FIG. 9 is a cross-sectional view of a flat coreless vibration motor equipped with a fan in which the eccentric rotor that is shown in FIG. 8 is contained in a state shown by cutting along the D-D line.

FIG. 8 and FIG. 9 show a coreless eccentric motor of a fifth embodiment of the present invention. An eccentric rotor R2 is equipped with a fan and has a commutator segment 81*b* which functions as a commutator and is formed by plating gold on one side of a printed circuit board 81 having a through hole 81*a* opened in a center of rotation, and two hollow armature coils 82 disposed radially outward of the through hole 81*a* on the other side of the printed circuit board 81 are disposed at an arrangement opening angle of 120°, so that one phase of three phases is missed. The hollow armature coils 82 receive electric power from the commutator segment 81*b*. An eccentric weight 83 in the form of a fan in the plan view thereof that is made from tungsten and has a specific gravity of 18 is disposed in the radial direction from the center of rotation on the opposite side from the two hollow armature coils 82 across the center of rotation. Due to the difference in specific gravity (about 10) between copper and tungsten, the center of gravity is displaced to the eccentric weight 83.

A nonmagnetic stainless steel thin sheet 84 with a thickness of about 0.2 mm is disposed via an acrylic two-side adhesive Ts on the upper surface of the hollow armature coils 82 and eccentric weight 83.

In this nonmagnetic stainless steel thin sheet 84, a central section 84*a* is provided by downward deformation in the axial direction and a depended section 84*b* is formed by squeezing an outer periphery also downward. The hollow armature coils 82 and eccentric weight 83 are sandwiched and held by fitting the central section 84*a* into the through hole 81*a* and fitting the depended section 84*b* onto the outer periphery of the printed circuit board 81. The eccentric weight 83 is concave-convexed locked, i.e., interlocked, with a key section 84*c* provided in the nonmagnetic stainless steel thin sheet 84 and a guide hole 81*c* opened in the printed circuit board 81 so as to withstand impacts occurring, for example, when the device is dropped. A sintered oil-impregnated bearing 85 is fixedly mounted on the central section 84*a* and functions as a shaft support section.

Furthermore, part of the depended section 84*b* is cut outwardly and eight vane-shaped impellers 84*d* are formed backward with respect to the rotation direction that is shown by an arrow, those impellers being a specific feature of the present application.

A notch 84*e* efficiently enables penetration of outside air during rotation, and thrust washers 86*a* and 86*b* are disposed above and below the bearing 85. It is especially preferred that the upper thrust washer 86*a* be a laminate comprising two or more layers in order to prevent breakage, despite the action of a pushing contact force of brushes B1, B2 (here, the brush B2 is in a position symmetrical to that of the brush B1 and is, therefore, omitted) If a size of the rotor in the radial direction can be increased, then the eccentric weight 83 can be eliminated by using the own weight (specific gravity about 8) of two hollow armature coils 82 as the eccentric center of gravity device.

The eccentric rotor R2 equipped with a fan and having the above-described configuration is accommodated in a housing H1 comprising a bracket 92, similar to the case 91, made from a magnetic stainless steel. In the bracket 92, a shaft 93 is press fitted into a shaft support section 92*a* provided upward by burring in the center, and the eccentric rotor R2 equipped with a fan is rotatably mounted on the shaft 93.

An axial gap magnet 94 is disposed on this bracket 92 so as to be even closer to the eccentric rotor R2 equipped with a fan. Positive and negative brushes are disposed with base end portions thereof connected to brush conductors. A brush B1 shown in FIG. 9 is exemplary having a base end connected to brush conductor 95. The brushes are provided so that distal end portions thereof are in sliding contact with the commutator segment 81*b* of the eccentric rotor R2 on the inner side of the magnet 94. Electric power is supplied to the eccentric rotor R2 via the brushes. A power supply terminal 95*a*, which is integrated with the brush conductor 95, is provided sidewise. The power supply terminal 95*a* is protected with a power supply terminal installation section 92*b* of the bracket 92. The power supply terminal 95*a* passes through a square hole 92*c* provided in the bracket 92 in the section where the magnet 94 is carried and serves to conduct electricity therethrough. Therefore, the thickness of the brush conductor 95 in this portion can be ignored. Thus, electric power can be supplied without sacrifices in terms of thickness.

In the case 91 constituting one side of the housing, an outside air inflow port 91*a* is provided in a ceiling section, and an outside air outflow port 91*b* is provided in a sidewise orientation. During the assembling, the distal end of the shaft 93 is received and stopped in a center and fixed with a laser weld L1. As for the side of the case, an open section is also fixed by a laser weld Ys to part of an outer periphery of the bracket 92 during an assembling operation.

As a result, a monocoque structure is configured and a sufficient impact resistance is obtained. Outside air is sucked in, as shown by the virtual line Y illustrated in FIG. 9, through the inflow port 91*a* provided in the ceiling section of the case, and is pushed out through the sidewise outflow port 91*b*. Therefore, if the structure is installed at a device, then the entire hot air locally generated in the device will be circulated, thereby providing for uniform temperature distribution and making it possible to reduce the temperature.

In the commutator disclosed hereinabove, a segment plated with gold is directly caused to function as a commutator, but the brushes may be also brought into sliding contact from the radial direction with a configuration in which a cylindrical commutator is attached to the above-described segment, if the motor thickness is sufficient.

Figure 10:
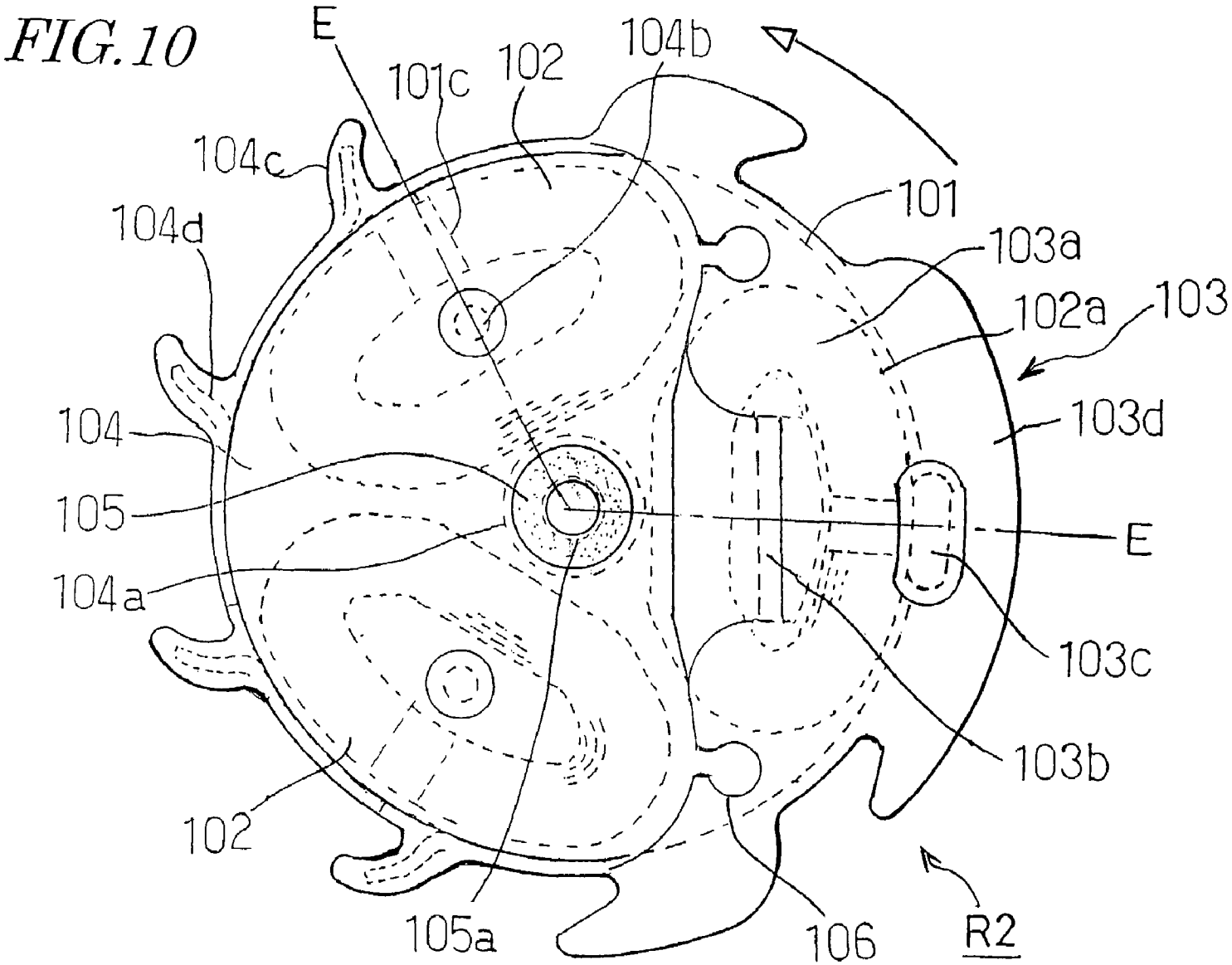
FIG. 10 is a plan view illustrating the first modification example of the eccentric rotor that is shown in FIG. 8 (Example 6).
Figure 11:
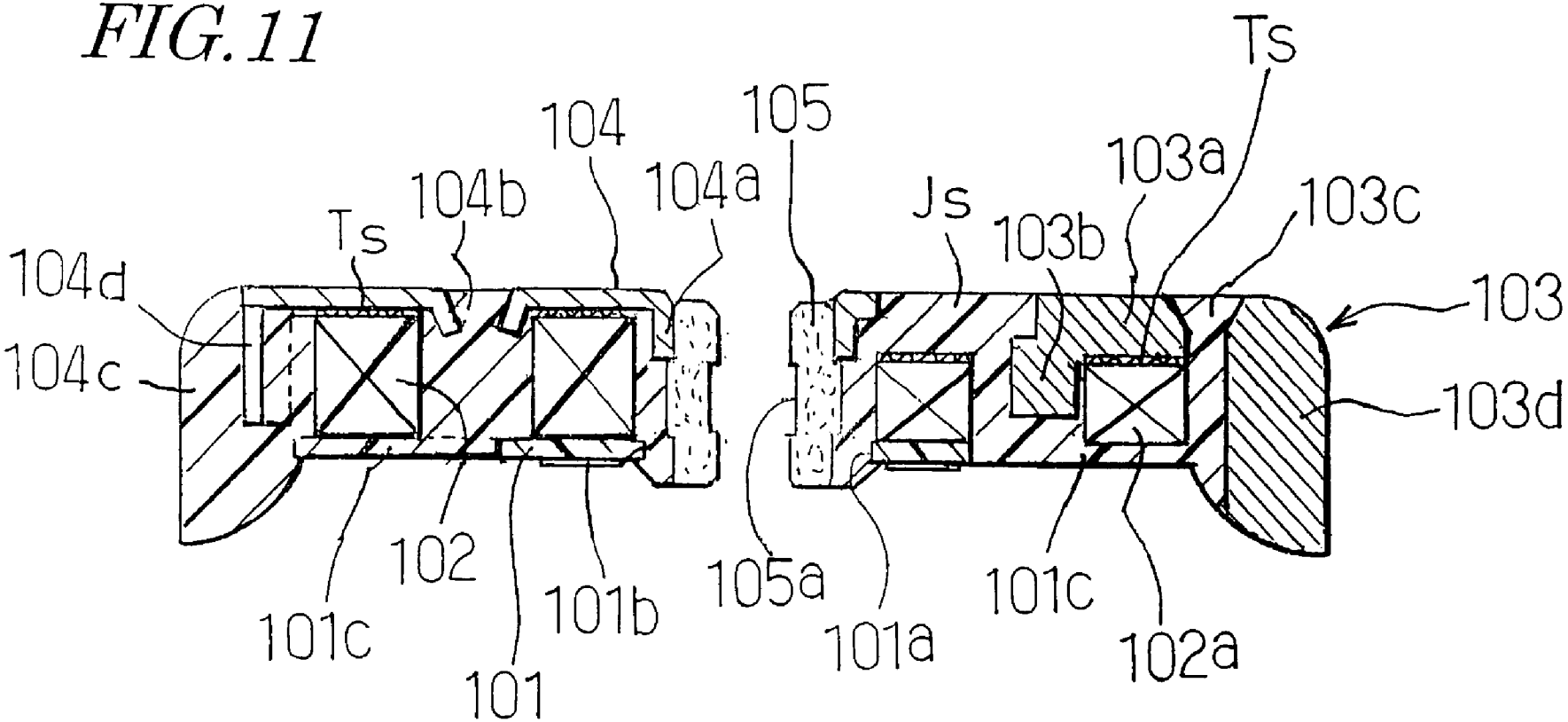
FIG. 11 is a cross-sectional view obtained by cutting along the E-E line the eccentric rotor shown in FIG. 10.

FIG. 10 and FIG. 11 illustrate a modification example of a sixth embodiment of the present invention which provides a coreless eccentric rotor equipped with a fan. In this example, a rotor comprises three hollow armature coils 102, 102, 102*a* arranged equidistantly and an eccentric weight 103 in order to ensure reliably the effective number of conductors and to increase the efficiency. A commutator segment 101*b* is formed in one side of a printed circuit board 101 having a through hole 101*a* open in the center of rotation and disposed outwardly in the radial direction. Electric power is received from the commutator segment 101*b*. The three hollow armature coils 102, 102, and 102*a* are disposed equidistantly, wherein the effective conductor sections identical to those of the above-described embodiment are expanded to the opening angles of magnetic poles and have an arrangement opening 120° in the plan view.

Here, one hollow armature coil 102*a* is made thinner than the other two hollow armature coils 102 in order to ensure the eccentricity, and superposition is attained by bonding a flat section 103*a*, which is part of the eccentric weight 103, via a two-side adhesive Ts. Such a configuration ensures an increased displacement of the center of gravity.

A nonmagnetic stainless steel thin plate 104 is bonded also via the two-side adhesive Ts to the other two hollow armature coils 102. In this nonmagnetic stainless steel thin plate 104, a bearing 105, formed to have a central recess 105*a* to reduce the bearing loss, is fit into a central burred section 104*a*, thereby creating a shaft support section. In the nonmagnetic stainless steel thin plate 104, protruding sections 104*b* in the form of a shallow funnel are formed in positions on an inner diameter side of the two hollow armature coils 102, part of an outer periphery is formed to serve as a frame 104*d* of the impeller 104*c*, and the impeller 104*c*, including the frame 104*d*, is integrally formed from a resin Js with a low specific gravity. At this time, a through groove 101*c* of the resin Js is opened in the printed circuit board 101, the resin Js flows through to the inner diameter side of the coils, the resin Js extends into the funnel-like protruding sections 104*b* and the nonmagnetic stainless steel thin plate 104 is held thereby.

The eccentric weight 103 is assembled with the nonmagnetic stainless steel thin plate 104 with a key-like concave-convex locking, i.e. interlocking section 106 and is thereby prevented from slipping out in the radial direction.

The eccentric weight 103 further comprises a depended section 103*b*, provided with a step, inserted into the inner diameter side of the thin hollow armature coil 102*a* and a hole 103*c* for passing a resin that functions as a lock. The eccentric weight 103 is integrally attached and held with the resin Js via a through groove 101*c* for the resin Js opened in the above-described printed circuit board 101.

As for the outer periphery of the eccentric weight 103, the outer diameter of revolution during rotation in the direction shown by an arrow in FIG. 10 is almost equal to that of the resin impeller 104*c*, and the eccentric rotor R2 equipped with a fan is configured by forming the outer periphery by the three backward vane-type impellers 103*d* so as to obtain a large thickness in the rotation direction, i.e., a large circumferential length.

Therefore, in this example, outward air flow can be also obtained from an entire outer periphery. The outer periphery of both impellers 104*c*, 103*d* hangs down in the axial direction to provide for the required air flow.

Figure 12:
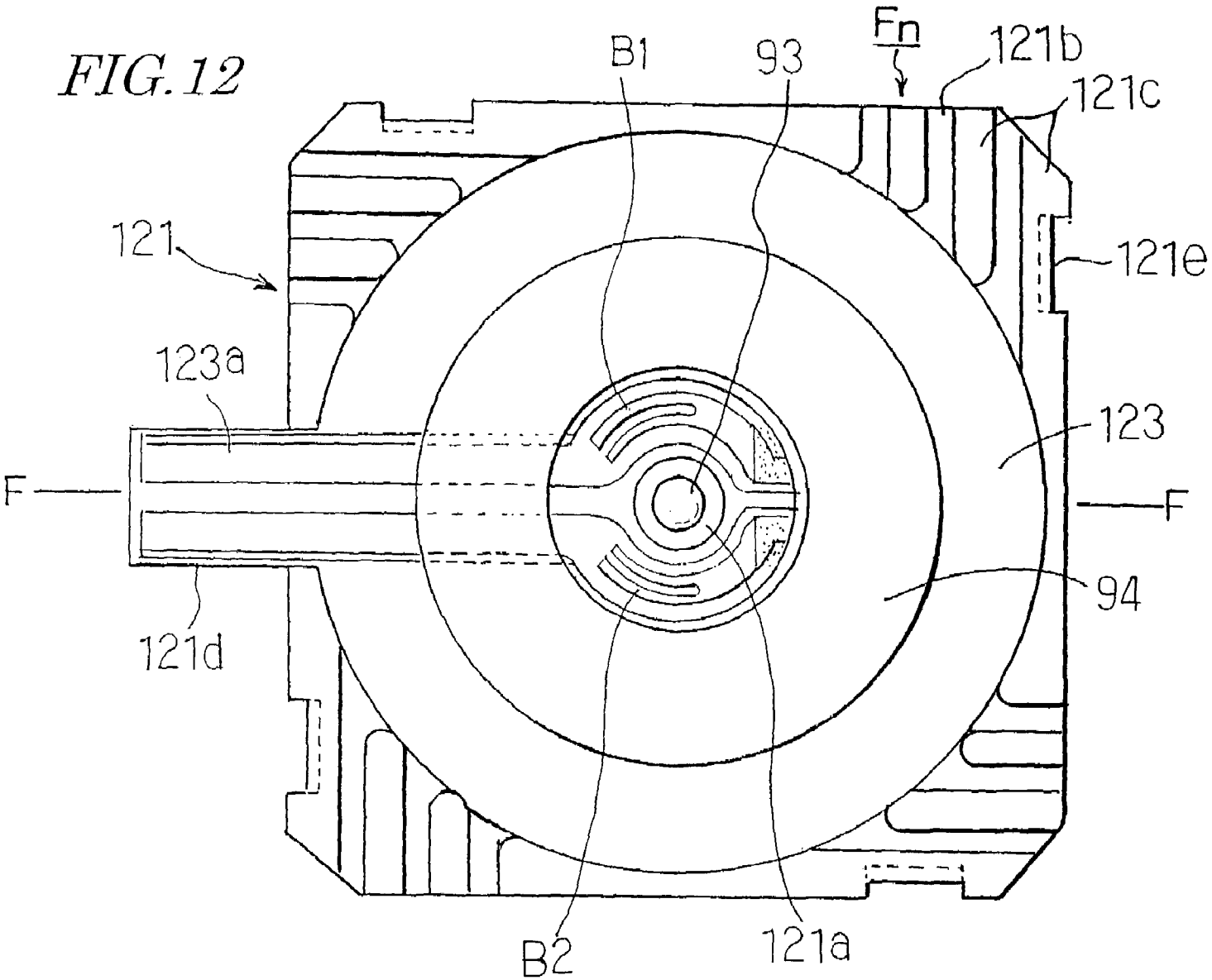
FIG. 12 is a plan view of the modification example of the stator portion shown in FIG. 9 (Example 7).
Figure 13:
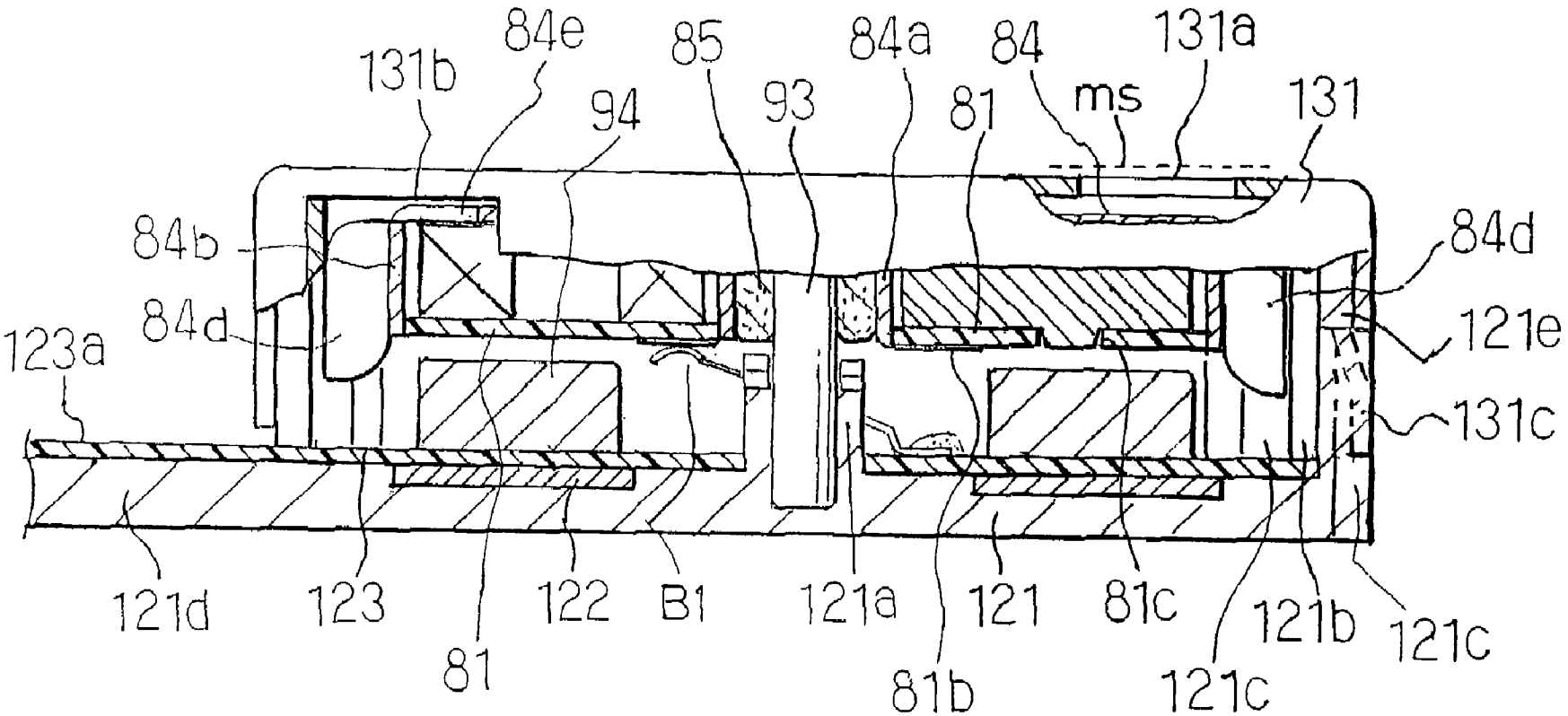
FIG. 13 is a cross-sectional view of a flat coreless vibration motor equipped with a fan in which the stator shown in FIG. 12 is contained in a state shown by cutting along the F-F line, this motor being a modification example of the motor shown in FIG. 9.

FIG. 12 and FIG. 13 illustrate an example of forming a heat sink, that is provided with heat-dissipating fins in four corners, from an aluminum die casting in which a bracket is formed to have an angular shape in the plan view thereof. Thus, a bracket 12 made from an aluminum die casting comprises a bearing holder 121*a* rising in the center, grooves 121*b* functioning as outflow ports for pushing out the air that flowed in and heat-dissipating fins Fn having heat-dissipating walls 121*c* in the four corners of the square. A shaft 93 is securely fixed to the bearing holder 121*a* by press fitting.

A magnetic yoke plate 122 is buried in an installation position of a below-described axial gap magnet on the outside of a bearing holder 121*a*, a brush conductor 123 made of a printed circuit board is disposed by bonding to an upper surface of the magnetic yoke plate 122, and a power supply terminal 123*a* is installed in a power supply terminal installation section 121*d* disposed extending sidewise.

In the bracket 121, a locking section 121*e*, for hooking a mounting leg section 131*c* of a case 131 made from a magnetic stainless steel, is formed at a heat-dissipating wall 121*c* on an outside of the heat-dissipating fin Fn.

The coreless eccentric rotor R2 equipped with a fan is accommodated in the same manner as shown in FIG. 8. Here, identical components are assigned with the same reference symbols and the explanation thereof is herein omitted.

The case 131, made form a magnetic stainless steel, comprises a plurality of outside air inflow ports 131*a* provided in the axial direction and an outside air outflow port 131*b* opened so that the air can flow in the radial direction. an outside air outflow port is provided in a position outside the position of the mounting leg section 131*c*. The assembling is conducted by latching the mounting leg section 131*c* with the locking section 121*e* of the bracket 121. The outflow port 131*b* may be provided in one location in a specific direction or in four locations so as to push out the air flow in all the radial directions.

Figure 14:
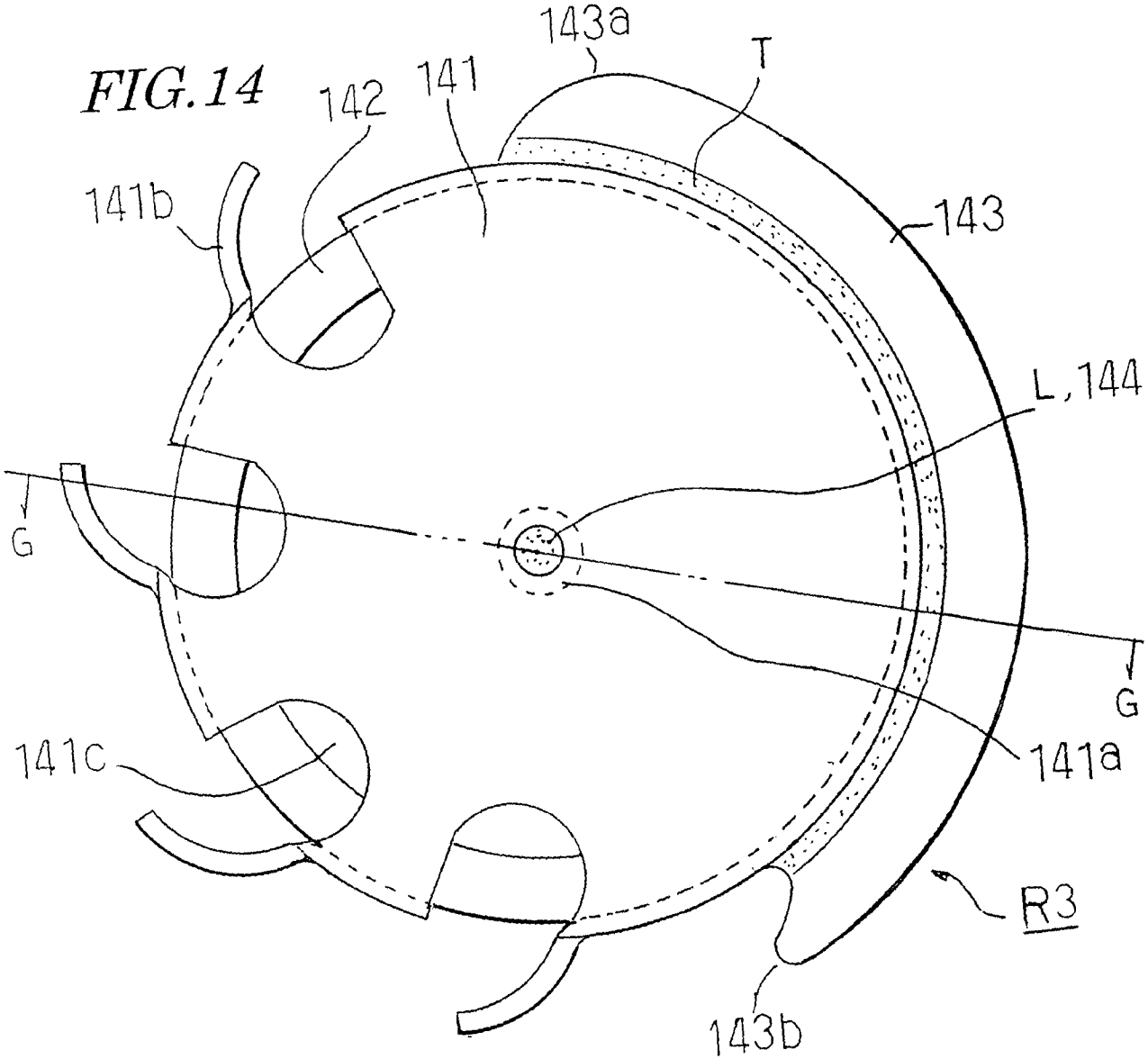
FIG. 14 is a plan view of the third implementation mode of the eccentric rotor in accordance with the present invention (Example 8).
Figure 15:
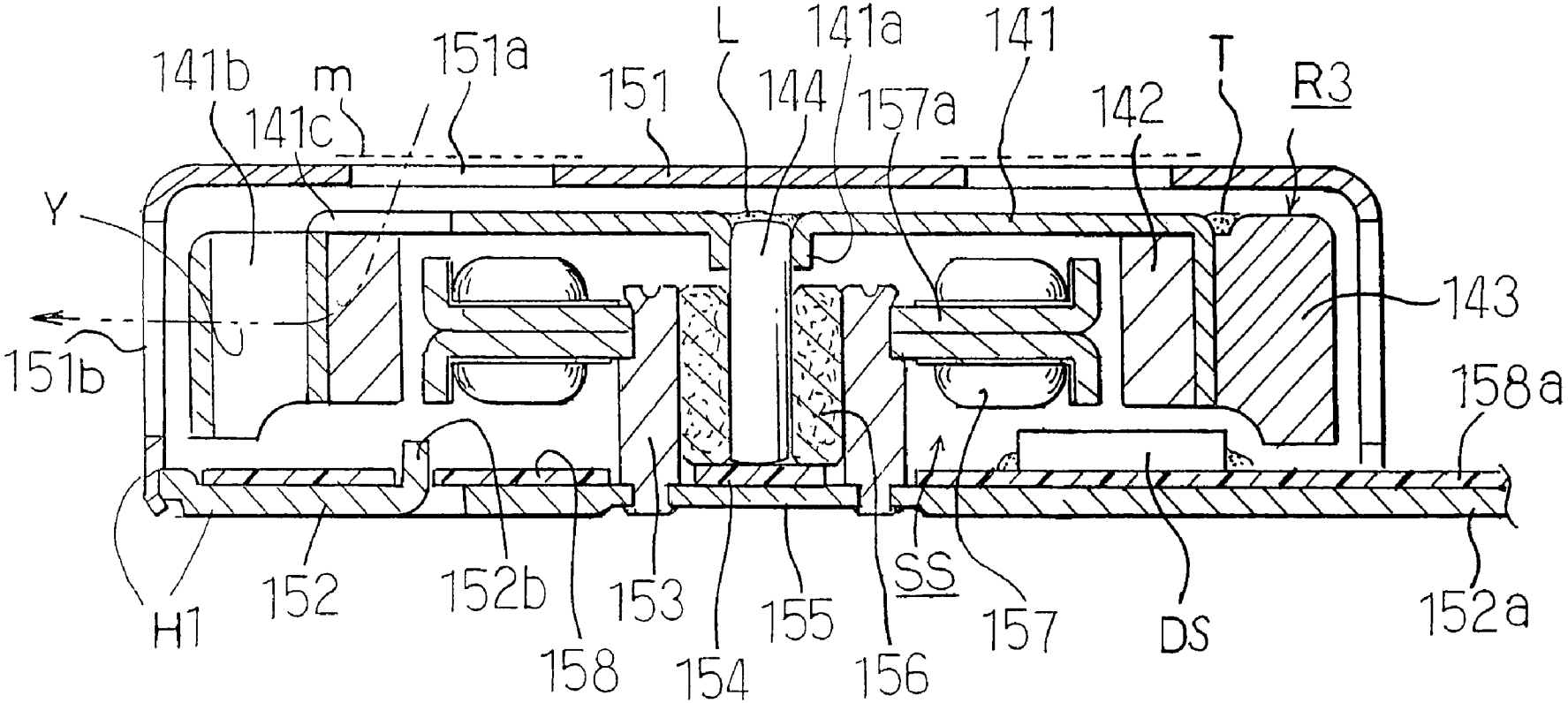
FIG. 15 is a cross-sectional view of a flat brushless motor equipped with a fan that contains the rotor shown in FIG. 14 in a state shown by cutting along the G-G line.

An eccentric rotor R3 of an eighth embodiment, shown in FIG. 14 and FIG. 15, comprises a shallow cup-like rotor case 141 made from a thin metal plate material with a specific gravity of 4 to about 8, a shallow cylindrical magnet 142 of a radial-gap type which is bonded to an inner side of the rotor case 141, and an arc-like eccentric member 143 made from tungsten and held by a laser weld T to the side of the rotor case 141. A shallow burr-shaped shaft support section 141*a* is provided in a center of rotation of the cup-like rotor case 141, and a shaft 144 is mounted thereon by a laser weld L at a distal end thereof.

A plurality of impellers 141*b* of the rotor case 141 are formed to have a shape backward with respect to the rotation direction by cutting and opening a side of the rotor case 141 that is opposite the arc-shaped eccentric member 143. Notch-like ports 141*c* are opened in the top portion of the rotor case 141 around the impellers 141*bb* to obtain a negative pressure effectively when outside air flows in.

In the arc-shaped eccentric member 143 a discharge portion 143*a* and a intake portion 143*b* are provided at both circumferential ends of the outer rotational diameter of the impeller 141*b*, and the entire body serves as a backward impeller.

Therefore, because the impeller 141*b* is formed in a position corresponding to the dead center on the revolution outer periphery of the arc-shaped eccentric member 143, the size of the impeller in the radial direction is not sacrificed.

Referring to FIG. 15, the eccentric rotor R3 equipped with a fan is accommodated in a housing H1 made of a case 151 and a bracket 152 constituting a motor with a diameter of 10-12 mm and a thickness of about 3-3.4 mm. A plurality of outside air inflow ports 151*a* are opened in a ceiling section of the case 151, and an outflow port 151*b*, through which the introduced outside air flows out, is provided in a side of the case 151. The outflow port 151*b* may be provided in one location in the direction of an active electronic component that is to be cooled or a plurality of outflow ports may be provided to push out the air flow on the entire outer periphery.

A mesh sheet m may be attached if the penetration of foreign matter from the outside air inflow ports 151*a* is a concern.

With such a configuration, because each impeller 141*b*, 143 of the eccentric rotor R3 is formed as a backward vane, outside air is sucked in by a negative pressure through outside air inflow ports 151*a* located in the top section as shown by a virtual line Y, and also the outside air is discharged and flows radially outward, under the effect of a positive pressure, from the sidewise outflow port 151*b*.

The bracket 152 is formed from a metal sheet, such as plate-like magnetic stainless steel, with a thickness of about 0.3 mm, and a bearing holder 153 made from brass is attached by laser welding to a center of the bracket. A thrust washer 154 and a backing plate 155 are disposed in a bottom section of the bearing holder 153, a bearing 156 rotatably supporting the eccentric rotor R3 via the shaft 144 is fit thereinto, and a base end of the shaft 144 is pivotally supported.

A power supply terminal installation section 152*a* is provided sidewise in the bracket 152.

Cored armature coils 157, wound over insulating films on two to four protruding poles 157*a* obtained by bending two cores with respect to each other in the axial direction and having an arrangement opening angle of 90°, are provided on an outer periphery of the bearing holder 153 located on the upper surface of the bracket 152 and disposed above stator bases 158 made of a glass cloth—epoxy resin substrate with a thickness of about 0.15 mm and additionally provided on the bracket 152. Ends of the cored armature coils 157 (not shown in the figures) are single-phase connected to prescribed wiring lands of the stator base 158, led out sidewise from the stator base 158, and integrated with a power supply terminal section 158*a* on the power terminal installation section 152*a*, thereby configuring a stator SS as a whole.

In the stator base 158, magnetic pieces 152*b* for detent torque generation, which react with magnetic poles of a magnetic field leakage of the radial-gap magnet 142 disposed in the rotor R3, protrude from the bracket 152. The number of magnetic pieces matches the number of poles of the magnet 142. When there is a space below the cored armature coil 157 as a location where no protruding pole 157*a* is disposed, one drive circuit member DS of a Hall sensor type with a thickness of about 0.5 mm is implanted so as to lay below the cored armature coil 157. When no such space below can be ensured, one cored armature coil may be removed to provide the space, and one drive circuit member DS of a Hall sensor type may be disposed therein. When a Hall output is insufficient due to the magnetic field leakage of the radial-gap magnet 142, one drive circuit member D2 of a Hall sensor type may be provided in a standing condition via a sub-substrate 165 in the space formed by removing one cord armature coil, as shown in the below-described FIG. 16 and FIG. 17, and the main magnetic field of the radial-gap magnet 142 may be received.

Figure 16:
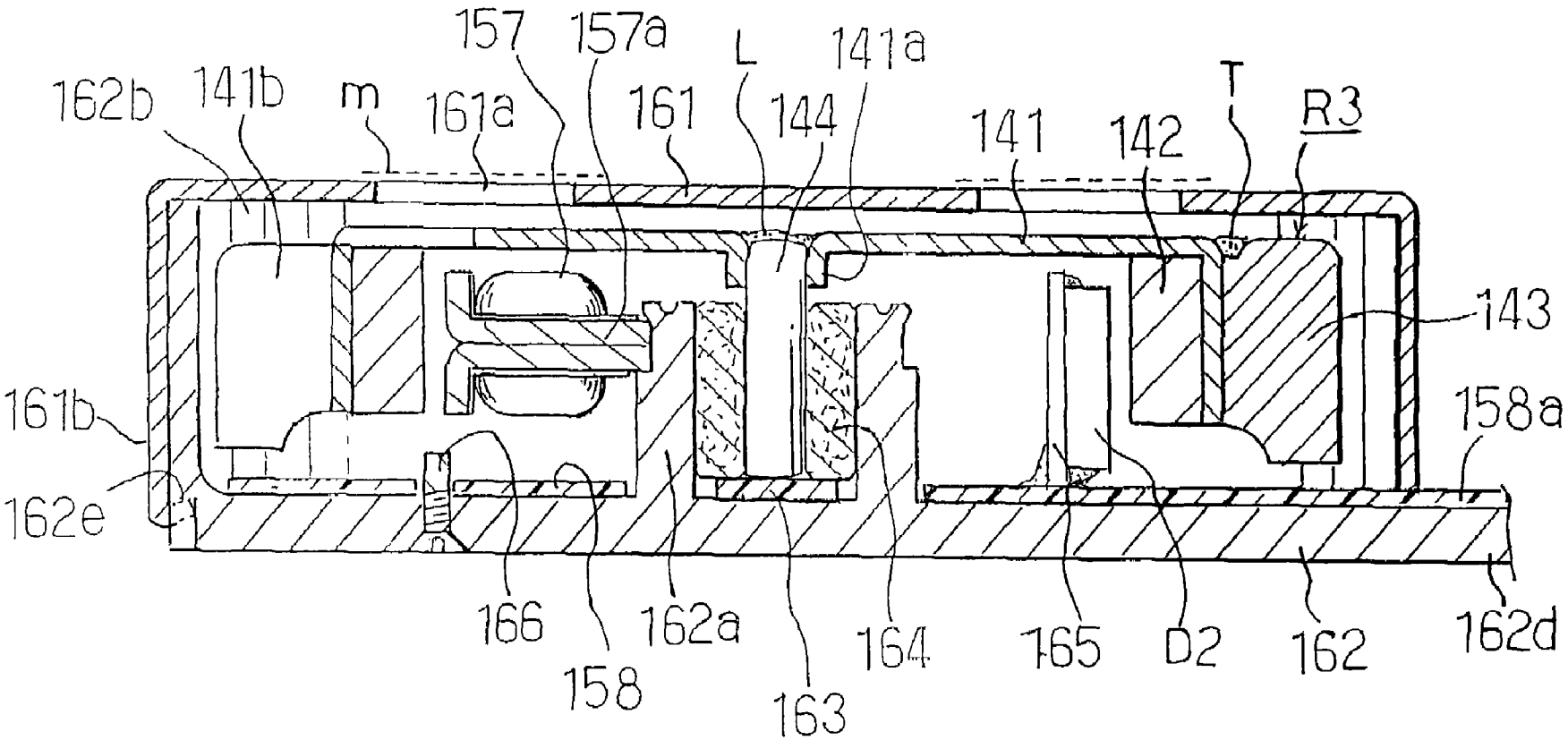
FIG. 16 is a cross-sectional view of the main portion of the modification example shown in FIG. 15 in which the stator is cut along the J-J line shown in FIG. 17 (Example 9).
Figure 17:
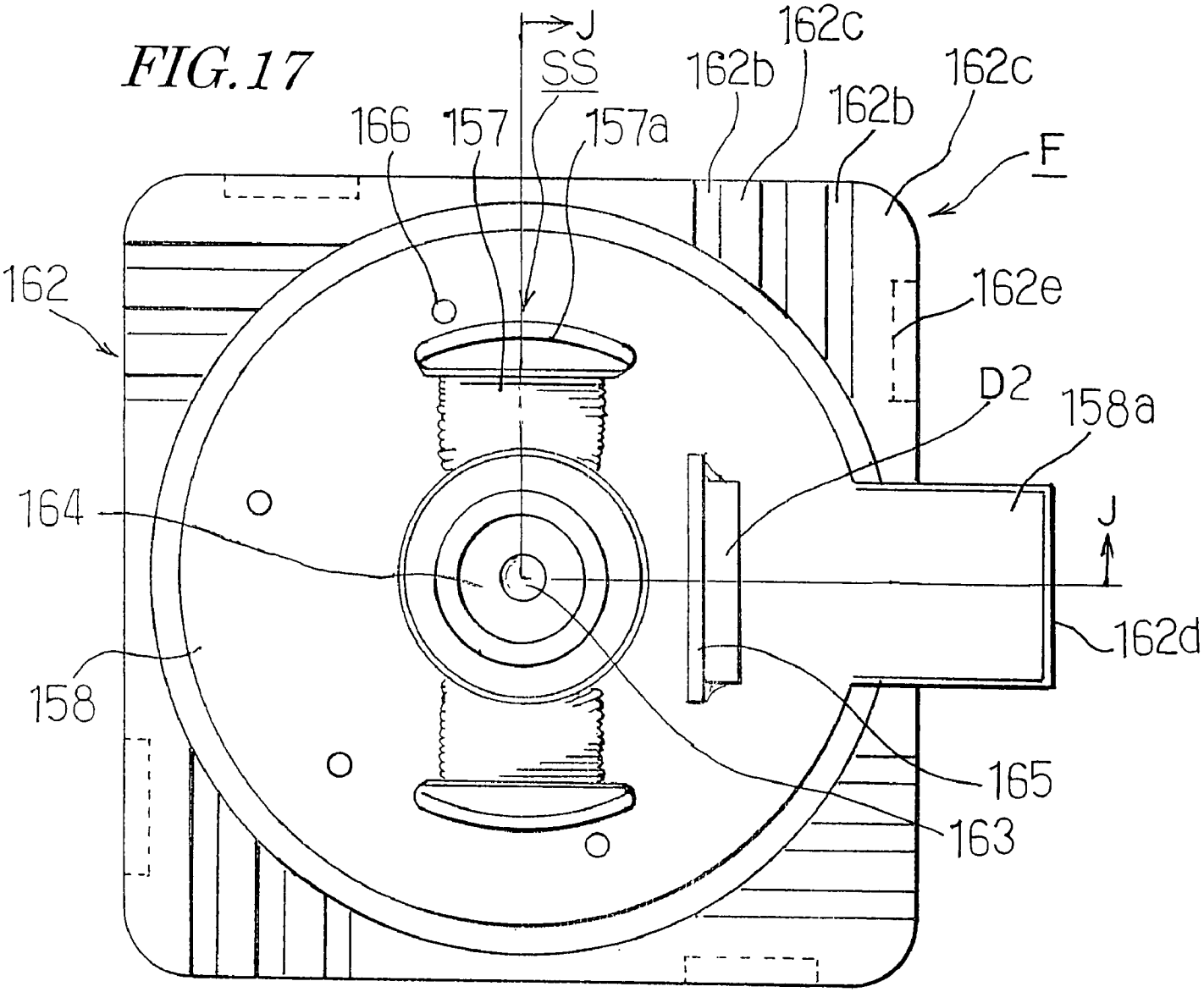
FIG. 17 is a plan view of the stator portion shown in FIG. 16.

FIG. 16 and FIG. 17 show a configuration of a ninth embodiment in which a stator side serves as a heat sink.

Components identical to those of the above-described embodiments are assigned with the same reference symbols and the explanation thereof is herein omitted.

A bracket 162, which is part of a housing, is made from an aluminum die casting having a square shape in a plan view thereof. A heat-dissipating fin F is formed which has a bearing holder 162*a* rising in a center portion, and grooves 162*b* and walls 162*c* functioning as outflow ports for pushing out the air that flowed in and located in the four corners of the square. A thrust washer 163 is disposed in a bottom section of the above-described bearing holder 162, the bearing 164 is accommodated therein, and a power supply terminal installation section 162*d* is formed sidewise.

In this embodiment, in contrast with the preceding embodiment, two of the four cored armature coils 157 with an arrangement opening angle of 90° are removed, a drive circuit member D2 of a Hall sensor type is disposed on a sub-substrate 165 and raised in any one space produced by removing the coils, and the main magnetic field of the radial-gap magnet 142 is received.

Furthermore, members 166 for detent torque generation are formed from cast iron screws and a plurality thereof are threaded with an arrangement pitch matching the magnetic pole opening angle (here, 60°) of the radial-gap magnet into the bracket 162 that has a comparatively large thickness.

A case 161 that is another part of the housing that is to be assembled with the bracket 162 of a heat sink type has an outside air inflow port 161*a* opened in a ceiling section thereof, and mounting leg sections 161*b* hang down therefrom.

In the case 161, at least a portion of the groove 162*b* of the sidewise heat-dissipating fin F is opened as an outflow port so as to enable radial air flow in locations other than those where a plurality of outside air inflow ports 161*a* and mounting leg sections 161*b* are provided in the axial direction. The lower ends of the mounting leg sections 161*b* are locked and attached to the locking sections 162*e* of the bracket 162. The outflow port may be provided in one location in the specific direction or such ports may be provided in four locations where the heat-dissipating fins are present to enable the air flow from the entire body.

If such vibration motor equipped with a fan has a device installed via a thermally conductive sheet of carbon or graphite, then the heat generated by the active electronic component is transferred to the aluminum heat-dissipating fins via the thermally conductive sheet, and the bracket 162 is efficiently cooled by the air flow.

Figure 18:
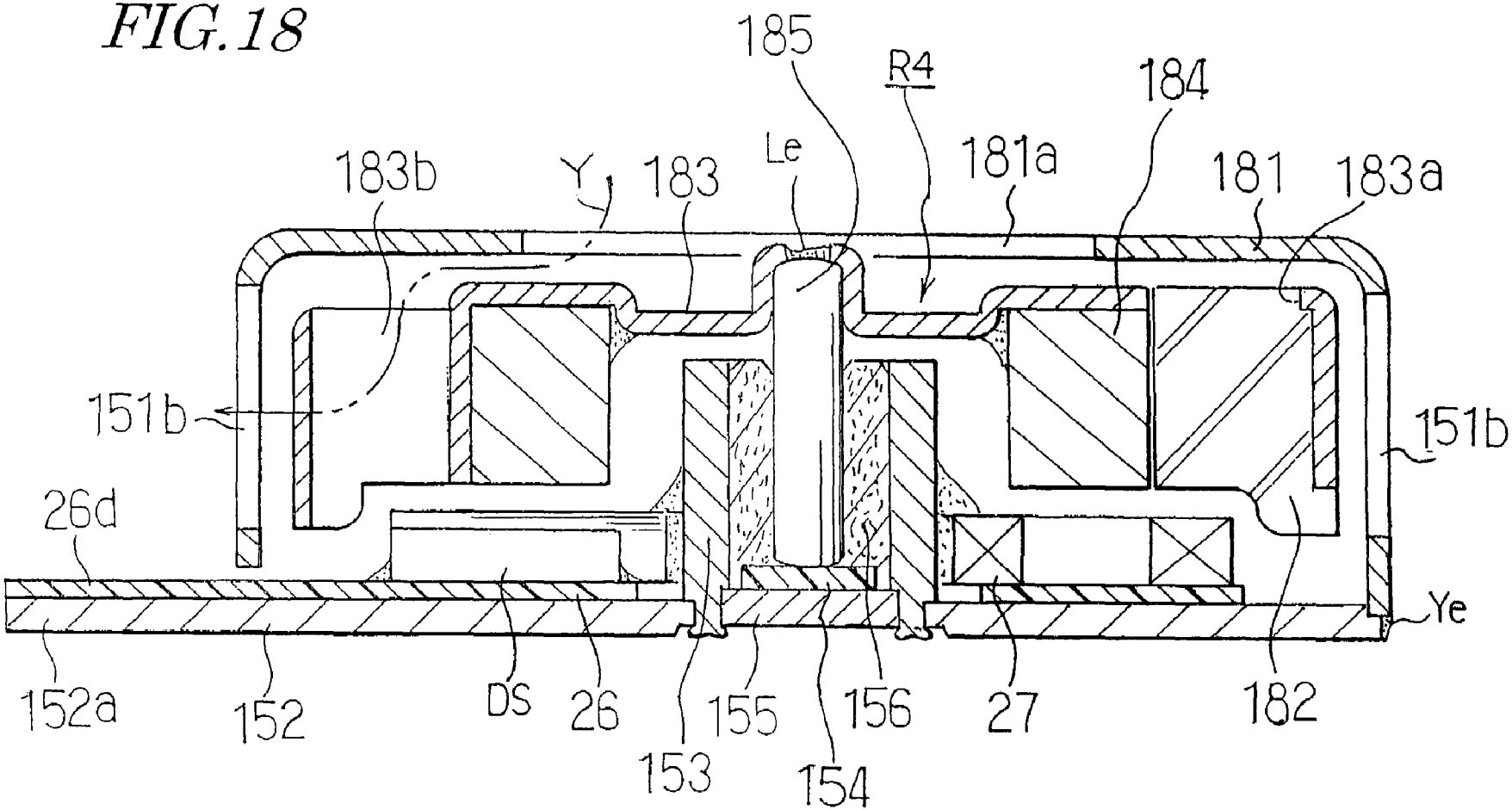
FIG. 18 is a cross-sectional view of the modification examples of FIGS. 2 and 15.

Referring to FIG. 18, a tenth embodiment of the present invention provides a modification of the embodiment shown in FIGS. 2 and 15 further improving the constitution of the rotor and achieving further efficiency of outside air inflow.

More specifically, an eccentric rotor R4, equipped with a fan, is configured such that a distal end of a shaft support section upwardly protrudes within a thickness of a larger diameter outside air inflow port 181*a* in a center of the case 181 that covers the rotor. With such a configuration, because an axial span of the bearing is increased, strength sufficient to withstand a radial impact on the rotor R4 is increased.

Because the member constituting the rotor R4 is configured such that a top portion of an eccentric weight 182 is fitted into a through hole 183*a* of a rotor case 183 to secure sufficient bonding surface, an impeller 183*b* is cut to protrude from the rotor case 183, and a magnet 184 is surrounded by the depended portion of the rotor and the eccentric weight 182, sufficient bonding strength is achieved. A shaft 185 is press inserted in a burr shaped portion provided in the center of the rotor case 183, and is secured by a laser weld Le at a top portion thereof.

Because the bracket is identical to that of FIG. 15, and the stator base and air-cored armature coil are identical to those of FIG. 2, the same reference symbols are assigned thereto, and explanation thereof is omitted.

With such a configuration, because a large amount of air is taken in by the larger diameter outside air inflow ports 181*a*, air can be caused to flow from outside air outflow ports as shown by the virtual line, thereby increasing the amount of air flow.

FIELD OF INDUSTRIAL APPLICABILITY

The flat vibration motor equipped with a fan in accordance with the present invention can be employed in cellular phones and also portable small computer devices such as PDA.

The motor of a rotary fixed type was explained as an example of the configuration in accordance with the present invention, but the present invention is also applicable to motors of a fixed shaft type.

The aforementioned thermally conductive sheet may be a metal sheet with a high thermal conductivity, e.g., copper and aluminum foil.

The present invention can be implemented in a variety of other modes, without departing from the technological scope and essence thereof. Therefore, the above-described modes for carrying out the invention are merely illustrative and should not be construed as limiting. The technological scope of the present invention is described by the claims and is not limited by the description.

What is claimed is:

1. A flat eccentric rotor equipped with a fan, comprising the following structural elements:

a shaft support section provided in a center of rotation of said flat eccentric rotor;

an electromagnetic drive device disposed radially outwardly of said shaft support section, said electromagnetic drive device being an axial-gap magnet;

an eccentric weighting device shifting a center of gravity of said rotor to an eccentric position relative said center of rotation, the eccentric weighting device being disposed radially outwardly of the shaft support section, said electric weighting device being an eccentric member comprising tungsten and disposed at least radially outwardly of said magnet;

an impeller section provided at at least one portion on an outer periphery of the rotor;

said impeller section being a portion of a first fan member of a low specific gravity relative to said eccentric member and said impeller section being disposed at least on an opposite side of said rotor from said eccentric member;

said impeller section of said first fan member and an outer periphery of said eccentric member at least partially extend in an axial direction of said rotor;

said impeller section being a first impeller section;

said eccentric member being configured as a second fan member with a high specific gravity relative to said first fan member and has a second impeller section at said outer periphery;

said first fan member including a first flat section radially inward of said first impeller section;

said second fan member comprising a second flat section above said axial-gap magnet and said second impeller section being disposed radially outwardly of said magnet and said second flat section; and said first and second the fan members being connected via said first and second flat sections which are bonded to and held by said axial-gap magnet.

2. The flat eccentric rotor according to claim 1, wherein:

said first and second impeller sections are configured as backward vanes and are formed to subscribe outer peripheries of rotation of almost the same diameter; and the second impeller section of the second fan member has a larger thickness than said first impeller section.

3. A flat eccentric rotor equipped with a fan, comprising the following structural elements:

a shaft support section provided in a center of rotation of said flat eccentric rotor, said shaft support section being provided at a cup-shaped rotor case;

an electromagnetic drive device disposed radially outwardly of said shaft support section, said electromagnetic drive device being a radial-gap magnet disposed inside the rotor case;

an eccentric weighting device shifting a center of gravity of said rotor to an eccentric position relative said center of rotation, the eccentric weighting device being disposed radially outwardly of the shaft support section, the eccentric weighting device being an arc-shaped eccentric member disposed at least outwardly of the magnet;

an impeller section provided at at least one portion on an outer periphery of the rotor, said rotor case having a side periphery that is cut open at least at a side opposite said weighting member, across the center of rotation from said weighting member, to form the impeller section.

4. The flat eccentric rotor according to claim 3, wherein:

said impeller section is a first impeller section;

said eccentric member includes a second impeller section having an impeller blade with a thickness in the circumferential direction, larger than that of an impeller blade of said first impeller section; and said blades of said first and second impeller sections are of a backward vane type and formed so that outer peripheries of rotation thereof are of almost the same diameter.

5. A flat-type vibration motor comprising:

a flat eccentric rotor;

a shaft support section provided in a center of rotation of said flat eccentric rotor;

an electromagnetic drive device disposed radially outwardly of said shaft support section, said electromagnetic drive device being an axial-gap magnet;

an eccentric weighting device shifting a center of gravity of said rotor to an eccentric position relative said center of rotation, the eccentric weighting device being disposed radially outwardly of the shaft support section, said eccentric weighting device being an eccentric member comprising tungsten and disposed at least radially outwardly of said magnet;

an impeller section provided at at least one portion on an outer periphery of the rotor, said impeller section being a portion of a first fan member of a low specific gravity relative to said eccentric member and said impeller section being disposed at least on an opposite side of said rotor from said eccentric member;

a housing comprising a case accommodating the flat eccentric rotor and a bracket, and the case being provided with an outside air inflow port in the axial direction and an outside air outflow port in the radial direction;

a stator disposed in part of said housing, said stator including a single-phase armature coil for driving said eccentric rotor;

a detent torque generating member for stalling said magnet in a prescribed position; and one drive circuit member of a Hall sensor type for supplying electric power to said armature coil.

6. The flat eccentric rotor according to claim 5, wherein the impeller section of said first fan member and an outer periphery of said eccentric member at least partially extend in an axial direction of said rotor.

7. The flat eccentric rotor according to claim 6, wherein:

said impeller section is a first impeller section;

said eccentric member is configured as a second fan member with a high specific gravity relative said first fan member and has a second impeller section, at said outer periphery;

said first fan member includes a first flat section radially inward of said first impeller section;

said second fan member comprises a second flat section above said axial-gap magnet and said second impeller section is disposed radially outwardly of said magnet and said second flat section; and said first and second the fan members are connected via said first and second flat sections which are bonded to and held by said axial-gap magnet.

8. The flat eccentric rotor according to claim 7, wherein:

said first and second impeller sections are configured as backward vanes and are formed to subscribe outer peripheries of rotation of almost the same diameter; and the second impeller section of the second fan member has a larger thickness than said first impeller section.

9. The flat eccentric rotor according to claim 5, further comprising:

a magnetic plate disposed on an upper surface of said axial-gap magnet;

a shaft support section provided in said magnetic plate; and the first impeller section, of the first fan member, having a low specific gravity relative to said high specific gravity and being formed from a resin which is adhered to the magnetic plate.

10. The flat-type vibration motor according to claim 5, wherein at least part of said housing has an angular shape in the plan view thereof and a heat-dissipating fin functioning as an outside air outflow port disposed in one corner of said housing.

11. The flat eccentric rotor according to claim 10, wherein the impeller section of said first fan member and an outer periphery of said eccentric member at least partially extend in an axial direction of said rotor.

12. The flat eccentric rotor according to claim 11, wherein:

said impeller section is a first impeller section;

said eccentric member is configured as a second fan member with a high specific gravity relative said first fan member and has a second impeller section, at said outer periphery;

said first fan member includes a first flat section radially inward of said first impeller section;

said second fan member comprises a second flat section above said axial-gap magnet and said second impeller section is disposed radially outwardly of said magnet and said second flat section; and said first and second the fan members are connected via said first and second flat sections which are bonded to and held by said axial-gap magnet.

13. The flat eccentric rotor according to claim 12, wherein:

said first and second impeller sections are configured as backward vanes and are formed to subscribe outer peripheries of rotation of almost the same diameter; and the second impeller section of the second fan member has a larger thickness than said first impeller section.

14. The flat eccentric rotor according to claim 10, further comprising:

a magnetic plate disposed on an upper surface of said axial-gap magnet;

a shaft support section provided in said magnetic plate; and the first impeller section, of the first fan member, having a low specific gravity relative to said high specific gravity and being formed from a resin which is adhered to the magnetic plate.

15. A flat-type vibration motor comprising:

a flat eccentric rotor;

a shaft support section provided in a center of rotation of said flat eccentric rotor, said shaft support section being provided at a cup-shaped rotor case;

an electromagnetic drive device disposed radially outwardly of said shaft support section, said electromagnetic drive device being a radial-gap magnet disposed inside the rotor case;

an eccentric weighting device shifting a center of gravity of said rotor to an eccentric position relative said center of rotation, the eccentric weighting device being disposed radially outwardly of the shaft support section, the eccentric weighting device being an arc-shaped eccentric member disposed at least outwardly of the magnet;

an impeller section provided at at least one portion on an outer periphery of the rotor, said rotor case having a side periphery that is cut open at least at a side opposite said weighting member, across the center of rotation from said weighting member, to form the impeller section;

a housing comprising a case accommodating the flat eccentric rotor and a bracket, and the case being provided with an outside air inflow port in the axial direction and an outside air outflow port in the radial direction;

a stator disposed in part of said housing, said stator including a single-phase armature coil for driving said eccentric rotor;

a detent torque generating member for stalling said magnet in a prescribed position; and one drive circuit member of a Hall sensor type for supplying electric power to said armature coil.

16. The flat eccentric rotor according to claim 15, wherein:

said impeller section is a first impeller section;

said eccentric member includes a second impeller section having an impeller blade with a thickness in the circumferential direction, larger than that of an impeller blade of said first impeller section; and said blades of said first and second impeller sections are of a backward vane type and formed so that outer peripheries of rotation thereof are of almost the same diameter.

17. The flat-type vibration motor according to claim 15, wherein at least part of said housing has an angular shape in the plan view thereof and a heat-dissipating fin functioning as an outside air outflow port disposed in one corner of said housing.

18. The flat eccentric rotor according to claim 17, wherein:

said impeller section is a first impeller section;

said eccentric member includes a second impeller section having an impeller blade with a thickness in the circumferential direction, larger than that of an impeller blade of said first impeller section; and said blades of said first and second impeller sections are of a backward vane type and formed so that outer peripheries of rotation thereof are of almost the same diameter.

19. A flat eccentric rotor equipped with a fan, comprising the following structural elements:

a shaft support section provided in a center of rotation of said flat eccentric rotor;

an electromagnetic drive device disposed radially outwardly of said shaft support section, said electromagnetic drive device comprising a commutator disposed on one side of a printed circuit board and a hollow armature coil disposed radially outwardly of said shaft support section on another side of said printed circuit board and receiving electric power from said commutator;

an eccentric weighting device shifting a center of gravity of said rotor to an eccentric position relative said center of rotation, the eccentric weighting device being disposed radially outwardly of the shaft support section, said eccentric weighting device being eccentric weight made from tungsten;

an impeller section provided at at least one portion on an outer periphery of the rotor, said impeller section being formed from a metal plate having a flat plate portion on a flat side of the rotor and on a whole of the outer periphery of the rotor, and the metal plate has a curved side portion depended therefrom and extending in the axial direction.

20. A flat eccentric rotor equipped with a fan, comprising the following structural elements:

a shaft support section provided in a center of rotation of said flat eccentric rotor;

an electromagnetic drive device disposed radially outwardly of said shaft support section, said electromagnetic drive device comprising a commutator disposed on one side of a printed circuit board and a hollow armature coil disposed radially outwardly of said shaft support section on another side of said printed circuit board and receiving electric power from said commutator;

an eccentric weighting device shifting a center of gravity of said rotor to an eccentric position relative said center of rotation, the eccentric weighting device being disposed radially outwardly of the shaft support section; and a first impeller section provided at at least one portion on an outer periphery of the rotor, said first impeller section having at least one blade of a backward vane shape;

said eccentric weighting device being a tungsten eccentric weight, said eccentric weight being formed to have a diameter equal to that of an outer periphery of rotation of said first impeller section and is configured as a second impeller section having a thick backward impeller blade extending over a greater circumferential arc than each of said at least one blade of said first impeller section, and part of each of said first and second impeller sections extends in the axial direction of said rotor.

21. The flat eccentric rotor according to claim 20, wherein said hollow armature coil and said eccentric weight are integrated with a resin via said printed circuit board, and at least part of said first impeller section is formed from the same said resin.

22. A flat-type vibration motor comprising:

a flat eccentric rotor;

a shaft support section provided in a center of rotation of said flat eccentric rotor;

an electromagnetic drive device disposed radially outwardly of said shaft support section, said electromagnetic drive device comprising a commutator disposed on one side of a printed circuit board and a hollow armature coil disposed radially outwardly of said shaft support section on another side of said printed circuit board and receiving electric power from said commutator;

an eccentric weighting device shifting a center of gravity of said rotor to an eccentric position relative said center of rotation, the eccentric weighting device being disposed radially outwardly of the shaft support section;

an impeller section provided at at least one portion on an outer periphery of the rotor;

a housing comprising a case accommodating the flat eccentric rotor and a bracket, and the case having an outside air inflow port in the axial direction and an outside air outflow port in the radial direction;

an axial-gap magnet disposed in said housing so as to be adjacent to said flat eccentric rotor so as to develop rotation force in conjunction with said hollow armature coil;

a brush having a distal end that is brought into sliding contact with the commutator of said flat eccentric rotor; and a brush conductor having a base end portion of said brush disposed thereat; wherein part of said brush conductor is disposed recessed in a cut extending transversely below said axial-gap magnet and led out sidewise to provide a power supply terminal.

23. The flat eccentric rotor according to claim 22, wherein:

said impeller section is formed from a metal plate having a flat plate portion on a flat side of the rotor and on a whole of the outer periphery of the rotor, the metal plate having a curved side portion depended therefrom and extending in the axial direction, and said eccentric weighting device is an eccentric weight made from tungsten.

24. The flat eccentric rotor according to claim 22, wherein:

said impeller section is a first impeller section;

said first impeller section has at least one blade of a backward vane shape;

said eccentric weighting device is a tungsten eccentric weight, said eccentric weight is formed to have a diameter equal to that of an outer periphery of rotation of said first impeller section and is configured as a second impeller section having a thick backward impeller blade extending over a greater circumferential arc than each of said at least one blade of said first impeller section, and part of each of said first and second impeller sections extends in the axial direction of said rotor.

25. The flat eccentric rotor according to claim 22, wherein said hollow armature coil and said eccentric weight are integrated with a resin via said printed circuit board, and at least part of said first impeller section is formed from the same said resin.

26. The flat-type vibration motor according to claim 22, wherein at least part of said housing has an angular shape when seen in the plan view and a heat-dissipating fin functioning as an outside air outflow port disposed in one corner of said housing.

27. The flat eccentric rotor according to claim 26, wherein:

said impeller section is formed from a metal plate having a flat plate portion on a flat side of the rotor and on a whole of the outer periphery of the rotor, and the metal plate has a curved side portion depended therefrom and extending in the axial direction, and said eccentric weighting device is an eccentric weight made from tungsten.

28. The flat eccentric rotor according to claim 26, wherein:

said impeller section is a first impeller section;

said first impeller section has at least one blade of a backward vane shape;

said eccentric weighting device is a tungsten eccentric weight, said eccentric weight is formed to have a diameter equal to that of an outer periphery of rotation of said first impeller section and is configured as a second impeller section having a thick backward impeller blade extending over a greater circumferential arc than each of said at least one blade of said first impeller section, and part of each of said first and second impeller sections extends in the axial direction of said rotor.

29. The flat eccentric rotor according to claim 26, wherein said hollow armature coil and said eccentric weight are integrated with a resin via said printed circuit board, and at least part of said first impeller section is formed from the same said resin.

* * * * *